US007703763B2

(12) United States Patent
Shiohara et al.

(10) Patent No.: US 7,703,763 B2
(45) Date of Patent: Apr. 27, 2010

(54) SHEET CONVEYING DEVICES AND IMAGE RECORDING APPARATUSES INCLUDING THE SAME

(75) Inventors: Yukio Shiohara, Nagoya (JP); Keisuke Wakakusa, Nagoya (JP); Tetsuo Asada, Kuwana (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 12/183,048

(22) Filed: Jul. 30, 2008

(65) Prior Publication Data

US 2009/0033024 A1 Feb. 5, 2009

(30) Foreign Application Priority Data

Jul. 30, 2007 (JP) ..... 2007-197941
Feb. 29, 2008 (JP) ..... 2008-050606

(51) Int. Cl.
*B65H 1/00* (2006.01)

(52) U.S. Cl. ..... 271/145; 271/171; 271/109; 271/110; 271/117; 271/118; 271/121; 271/126; 271/127

(58) Field of Classification Search ..... 271/117, 271/109, 110, 118, 145, 171, 121, 126, 127
See application file for complete search history.

(56) References Cited

U.S. PATENT DOCUMENTS 5,887,867 A * 3/1999 Takahashi et al. ..... 271/117
6,382,620 B1 * 5/2002 Gaarder et al. ..... 271/117
6,431,541 B2 * 8/2002 Kuo et al. ..... 271/118
6,540,220 B2 * 4/2003 Kuo et al. ..... 271/118
6,918,583 B2 * 7/2005 Asada et al. ..... 271/110
6,986,509 B2 * 1/2006 Koh et al. ..... 271/110
7,516,953 B2 * 4/2009 Lee ..... 271/117
2002/0084574 A1 * 7/2002 Kim ..... 271/118
2007/0001375 A1 * 1/2007 Zhu ..... 271/117
2007/0081199 A1 * 4/2007 Koga et al. ..... 358/450
2007/0194515 A1 * 8/2007 Kozaki et al. ..... 271/126
2007/0267804 A1 * 11/2007 Kozaki et al. ..... 271/113
2007/0296138 A1 * 12/2007 Su ..... 271/109

FOREIGN PATENT DOCUMENTS

JP 200762965 A 3/2007

* cited by examiner

*Primary Examiner*—Patrick H Mackey
*Assistant Examiner*—Prasad V Gokhale
(74) *Attorney, Agent, or Firm*—Baker Botts L.L.P.

(57) ABSTRACT

A sheet conveying device includes a tray having a bottom surface. The tray holds at least one sheet therein, and has a recess formed in the bottom surface. A rotating member moves between a first position and a second position. In the first position, the rotating member contacts a sheet held in the tray, and in the second position, the rotating member is separated from the tray. The rotating member selectively rotates to convey a sheet held in the tray in a when the rotating member is in the first position. An operative portion moves in and out of the recess in the bottom surface of the tray, and movement of the operative portion corresponds to a movement of the rotating member into the second position.

17 Claims, 20 Drawing Sheets

SHEET CONVEYING DEVICES AND IMAGE RECORDING APPARATUSES INCLUDING THE SAME

CROSS REFERENCE TO RELATED APPLICATION

The present application claims priority from Japanese Patent Applications No. 2007-197941, filed on Jul. 30, 2007, and No. 2008-050606, filed on Feb. 29, 2008, the disclosure of which is incorporated herein by reference in its entirety.

BACKGROUND

1. Field of the Invention

The present invention relates to a sheet conveying device comprising a positioning member configured to place sheets held in a tray in position and an image recording apparatus including the sheet conveying device.

2. Description of Related Art

Known sheet conveying devices separate sheets stacked in a tray one by one and convey the sheets to a recording section. In such sheet conveying devices, as a pickup roller is driven with its roller surface contacting a sheet, sheets are conveyed from the tray to a predetermined conveying direction while being separated one by one by friction. A known sheet conveying device includes a pickup roller rotatably supported at an end of an arm, which is configured to move pivotally. In the sheet conveying device, a few sheets remaining in the tray may be conveyed simultaneously. Feeding of a plurality of sheets simultaneously may be called multiple sheet feeding. To prevent multiple sheet feeding by reliably separating sheets, a friction member having a predetermined frictional coefficient is positioned on a sheet mounting surface of the tray. The friction member is positioned to face the pickup roller on the sheet mounting surface. The friction member will reduce the possibility of multiple sheet feeding because the frictional force applied between the tray and the sheets becomes greater than the frictional force applied between the sheets.

When the tray becomes empty as the last one sheet remaining in the tray is conveyed, the pickup roller and the friction member contact each other. In this case, contact and friction between the pickup roller and the friction member apply excessive loads to the pickup roller. To prevent excessive load to the pickup roller, a known image recording apparatus, e.g., an image recording apparatus described in U.S. Patent Application Publication No. 20070081199, corresponding to Japanese Laid-Open Patent Publication No. 2007-62965, discloses a moving device configured to raise the pickup roller away from the friction member when the tray becomes empty. The moving device reduces excessive loads applied to the pickup roller.

However, the sheet conveying device including the moving device may not convey sheets, depending on the sizes of sheets in the conveying direction, as the moving device raises the pickup roller before the leading edge of a sheet reaches a conveying device positioned downstream of the pickup roller in the conveying direction.

SUMMARY

Therefore, a need has arisen for a sheet conveying device and an image recording apparatus including the sheet conveying device which overcome these and other shortcomings of the related art. A technical advantage of the present invention is to reduce excessive loads applied to a pickup roller when the sheet conveying device conveys sheets of sizes greater than a predetermined size and to reduce sheet feeding failures, e.g., sheet jam, when the sheet conveying device conveys sheets of sizes smaller than the predetermined size.

In an embodiment, a sheet conveying device comprises a tray comprising a bottom surface, wherein the tray is configured to hold at least one sheet therein, and has a recess formed in the bottom surface, a particular rotating member configured to move between a first position in which the particular rotating member contacts the at least one sheet held in the tray and a second position in which the particular rotating member is separated from the tray, and wherein the particular rotating member is configured to rotate to selectively convey one of the at least one sheet held in the tray in a particular direction when the particular rotating member is in the first position, a particular operative portion configured to selectively move into and out of the recess, wherein a movement of the particular operative portion into the recess corresponds to a movement of the particular rotating member into the second position, a moving device configured to selectively move the particular operative portion into and out of the recess, a positioning member configured to move along the bottom surface of the tray between a first bottom position and a second bottom position, and a preventing member configured to prevent the particular operative portion from moving into the recess when the positioning member is in the second bottom position, wherein when the positioning member is in the second bottom position, the tray is configured to hold a sheet of a first predetermined size, and when the positioning member is in the first bottom position the tray is configured to hold a sheet of a second predetermined size, which is greater than the first predetermined size.

In another embodiment, a sheet conveying device comprises a tray comprising a bottom surface, wherein the tray is configured to hold at least one sheet therein, and has a recess formed in the bottom surface, a particular rotating member configured to move between a first position in which the particular rotating member contacts the at least one sheet held in the tray and a second position in which the particular rotating member is separated from the tray, and wherein the particular rotating member is configured to rotate to selectively convey one of the at least one sheet held in the tray in a particular direction when the particular rotating member is in the first position, a particular operative portion configured to selectively move into and out of the recess, wherein a movement of the particular operative portion into the recess corresponds to a movement of the particular rotating member into the second position, a moving device configured to selectively move the particular operative portion into and out of the recess, and a positioning member configured to move along the bottom surface of the tray between a first bottom position and a second bottom position, wherein the positioning member comprises a preventing member configured to cover at least a portion of the recess to prevent the particular operative portion from moving into the recess when the positioning member is in the second bottom position, and the tray is configured to hold a sheet of a first predetermined size, and when the positioning member is in the first bottom position the tray is configured to hold a sheet of a second predetermined size, which is greater than the first predetermined size.

In yet another embodiment, A sheet conveying device, comprises a tray comprising a bottom surface, wherein the tray is configured to hold at least one sheet therein, and has a recess formed in the bottom surface, a particular rotating member configured to move between a first position in which the particular rotating member contacts the at least one sheet held in the tray and a second position in which the particular rotating member is separated from the tray, and wherein the particular rotating member is configured to rotate to selectively convey one of the at least one sheet held in the tray in a particular direction when the particular rotating member is in the first position, a particular operative portion configured to selectively move into and out of the recess, wherein a movement of the particular operative portion into the recess corresponds to a movement of the particular rotating member into the second position, a moving device configured to selectively move the particular operative portion into and out of the recess, two positioning members, configured to move in opposite directions along the bottom surface of the tray, and two preventing members, each configured to prevent the particular operative portion from moving into the recess when the two positioning members are at a predetermined position.

In still a further embodiment, An image recording apparatus comprises a sheet conveying device and a recording device configured to record an image on the sheet conveyed by the sheet conveying device. The sheet conveying device comprises a tray comprising a bottom surface, wherein the tray is configured to hold at least one sheet therein, and has a recess formed in the bottom surface, a particular rotating member configured to move between a first position in which the particular rotating member contacts the at least one sheet held in the tray and a second position in which the particular rotating member is separated from the tray, and wherein the particular rotating member is configured to rotate to selectively convey one of the at least one sheet held in the tray in a particular direction when the particular rotating member is in the first position, a particular operative portion configured to selectively move into and out of the recess, wherein a movement of the particular operative portion into the recess corresponds to a movement of the particular rotating member into the second position, a moving device configured to selectively move the particular operative portion into and out of the recess, a positioning member configured to move along the bottom surface of the tray between a first bottom position and a second bottom position, and a preventing member configured to prevent the particular operative portion from moving into the recess when the positioning member is in the second bottom position, wherein when the positioning member is in the second bottom position, the tray is configured to hold a sheet of a first predetermined size, and when the positioning member is in the first bottom position the tray is configured to hold a sheet of a second predetermined size, which is greater than the first predetermined size.

In the sheet conveying device, a restriction member may be positioned at the positioning member positioned at each end of the tray in the lateral direction. The sheet held in the tray may be supported at each end thereof in the lateral direction by two positioning members. The restriction member may be disposed at the first plate of each of two positioning member. When each positioning member is moved to the second position, the movement of the first operative portion into the recess may be prevented. The sheet conveying device may further comprise a supporting device configured to support the restriction member when the positioning member is moved to the second position.

The positioning member may be configured to move relative to the tray, which may cause the positioning member to rattle, e.g., vibrations. The restriction member may be positioned on the positioning member, so that the restriction member may be influenced by the rattle of the positioning member. Due to the influence of the positioning member especially when the positioning member is moved to the second position, the position of the restriction member in the height, e.g., the vertical, direction may vary. Further, the restriction member may deform when first operative portion is supported by the restriction member, due to load applied by the moving mechanism to the restriction member. Due to the influence of rattle of the positioning member and deformation of the restriction member, the position of the restriction member in the height, e.g., the vertical, direction may vary when the positioning member is moved to the second position.

If the restriction member is positioned lower than a position where the restriction member is to be positioned to prevent the first operative portion from moving into the recess, the position to support the first operative portion by the restriction member may be lowered. In this case, when the trailing end of the sheet of the predetermined size passes the recess, the particular rotating member may move away from the bottom surface of the tray. Consequently, the rotating force of the particular rotating member may not be transmitted to the sheet of the predetermined size and sheet feeding failure may occur. However, the supporting device may support the restriction member when the positioning member is moved to the second position. Therefore, variances in positions of the restriction member in the height, e.g., vertical, direction may be reduced and movement of the first operative portion into the recess may be prevented when the sheet of the predetermined size is fed.

Therefore, the upper surface of the restriction member may be positioned lower than the upper surface of the first plate, to prevent the sheets from getting caught in the restriction member. According to the invention, the supporting device may raise the restriction member when the positioning member is moved to the second position, so that the movement of the first operative portion into the recess may be reliably prevented by the restriction member. In the sheet conveying device, the supporting device may be positioned adjacent to the recess on the bottom surface of the tray and comprise a protrusion configured to raise the restriction member or the first plate when the positioning member is moved to the second position. With this configuration, the restriction member or the first plate may be raised and positioned on the protrusion while the positioning member is being moved to the second position. Therefore, when the positioning member is placed in the second position, the restriction member may be supported while being raised by the protrusion.

When the sheet of a size larger than the predetermined size is conveyed, the particular rotating member may be moved away from the bottom plate after the last sheet is fed, so that the particular rotating member may rotate at idle. When the sheet of the predetermined size is conveyed, the particular rotating member may not be moved away from the bottom plate after the last sheet is fed. The rotating force of the particular rotating member may be transmitted to the sheet until the trailing end of the sheet passes the particular rotating member. Thus, such a sheet feeding failure may be reduced that the sheet of the predetermined size jams between the particular rotating member and the further rotating member.

An image recording apparatus may comprise the sheet conveying device and a recording device configured to record an image on a sheet conveyed by the sheet conveying device. The above features and advantages may be applied to the image recording apparatus comprising the sheet conveying device.

Other objects, features, and advantages will be apparent to persons of ordinary skill in the art from the following detailed description of the invention and the accompanying drawings.

BRIEF DESCRIPTION OF THE DRAWINGS

For a more complete understanding of the invention, needs satisfied thereby, and the objects, features, and advantages thereof, reference now is made to the following description taken in connection with the accompanying drawings.

DETAILED DESCRIPTION OF PREFERRED EMBODIMENTS

Embodiments of the invention and its features and technical advantages may be understood by referring to FIGS. 1-11B, like numerals being used for like corresponding portions in the various drawings.

Figure 1:
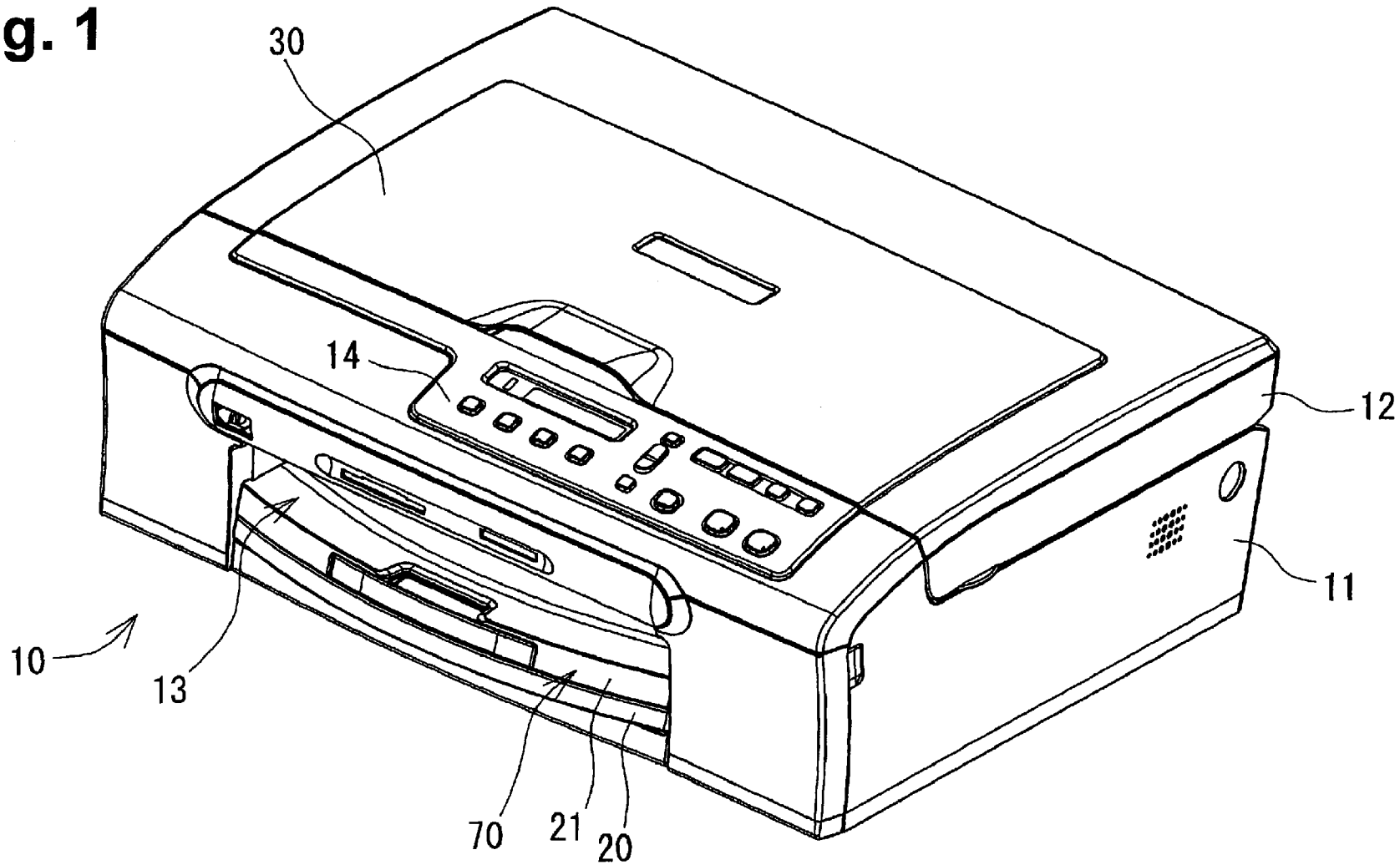
FIG. 1 is a perspective view of a multi-function device ("MFD"), as an image recording apparatus, according to an embodiment.

Referring to FIG. 1, in an embodiment of the invention, an image recording apparatus, e.g., a multi-function device ("MFD") 10, may comprise a printer section 11 and a scanner section 12. MFD 10 may have a printing function, a scanner function, a copying function and a facsimile function. In this embodiment, printer section 11 may be configured to perform inkjet image recording. Nevertheless, printer section 11 may be configured to perform laser-beam image recording using toner. The image recording apparatus according to an embodiment may function as a MFD having a plurality of functions or as a printer having only a printing function.

MFD 10 may have a hexahedron shape, the width and depth of which may be greater than its height. An upper portion of MFD 10 may include scanner section 12, which may be configured as a flat bed scanner. A document cover 30 may be pivotally positioned as a top cover of MFD 10. A platen glass and an image sensor (not shown) may be positioned under document cover 30 inside MFD 10. The image sensor may read an image on a document placed on the platen glass. Scanner section 12 optionally may be included to perform scanning operations in an embodiment of the invention, and a detailed description thereof is omitted herein.

Figure 2:
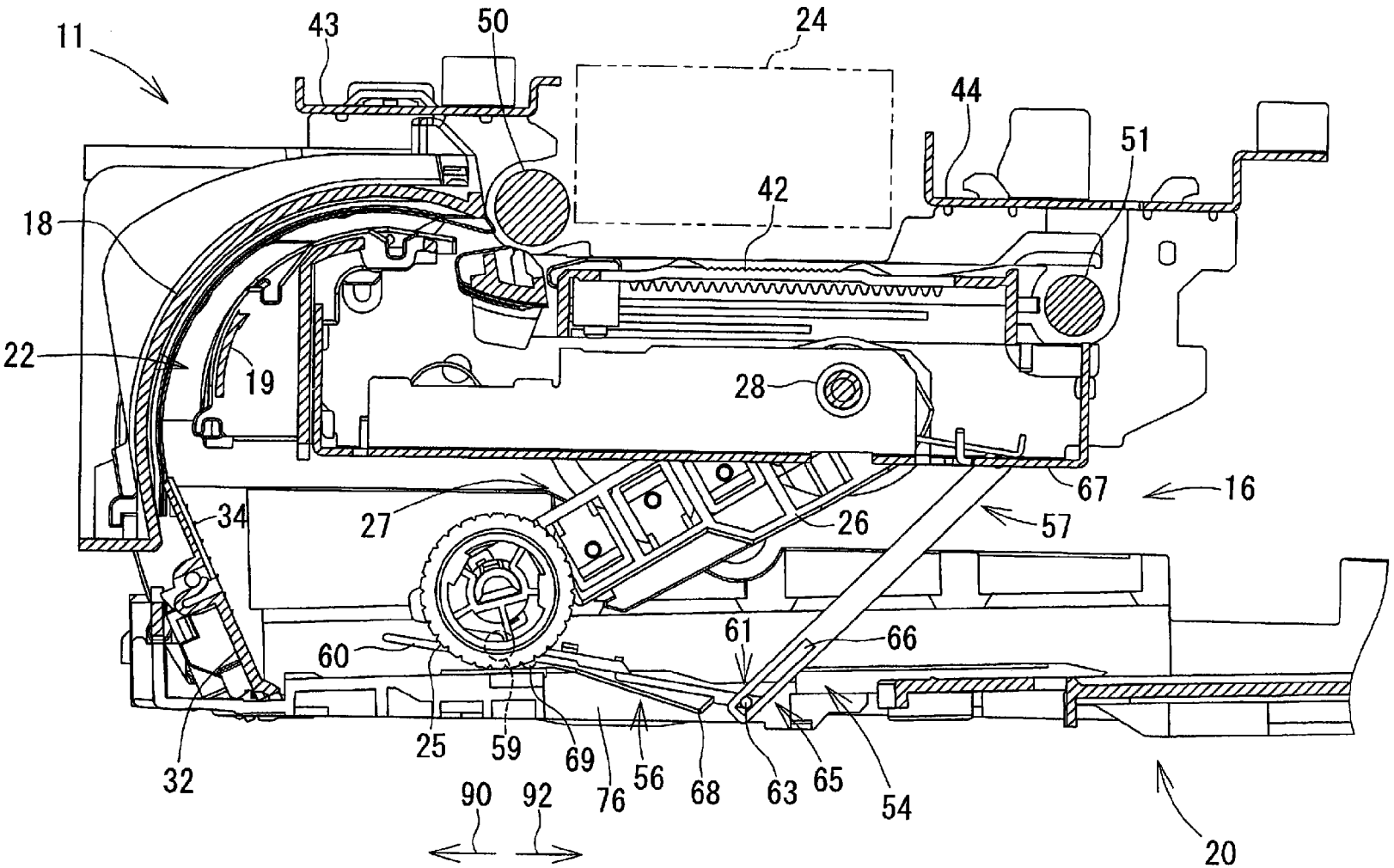
FIG. 2 is a cross-sectional view of a specific portion of a printer section of the MFD, according to an embodiment.

A lower portion of MFD 10 may comprise printer section 11. Printer section 11 may record an image, or text, or both, on a recording sheet, based on print data, e.g., image data or text data input from an external device, and image data read by scanner section 12. A sheet cassette 70 may be removably inserted into printer section 11 through an opening 13. Recording sheets held in sheet cassette 70 may be fed into printer section 11 by a sheet conveying device, e.g., a feeding device 16, as shown in FIG. 2. Printer section 11 may comprise a recording unit 24 configured to record an image on a recording sheet fed from sheet cassette 70.

A front upper portion of MFD 10 may comprise a control panel 14, which may comprise a liquid crystal display configured to display information, and input keys which may be used by a user to input information. MFD 10 may execute instructions input from control panel 14 or instructions transmitted from an external device. Printer section 11 and scanner section 12 may execute instructions input from control panel 14 or instructions transmitted from an external device via a printer driver or a scanner driver.

Figure 3:
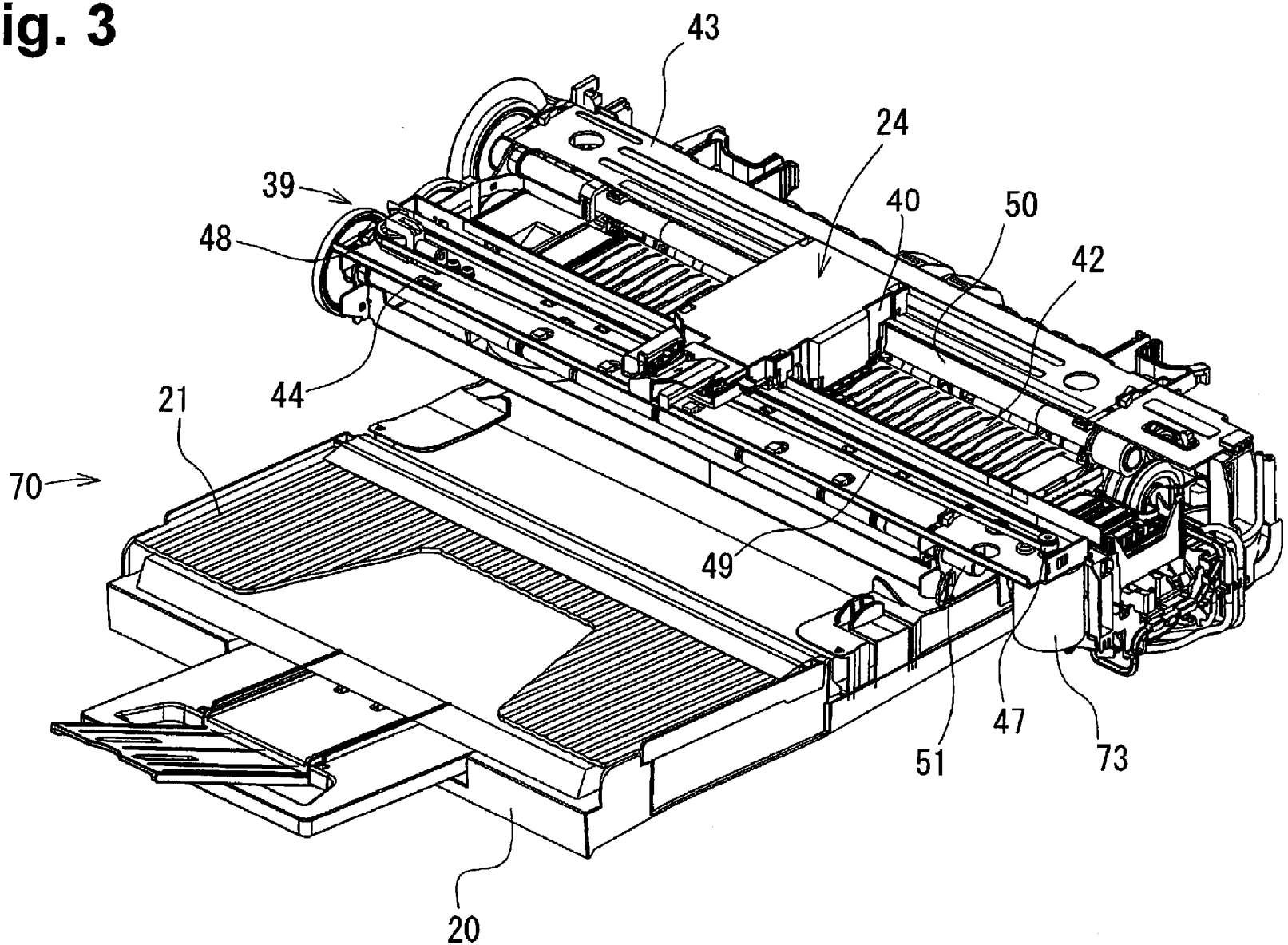
FIG. 3 is a perspective view of a recording unit of the printer section, according to an embodiment.

Referring to FIGS. 1-3, printer section 11 may comprise feeding device 16 and recording unit 24. Feeding device 16 may comprise sheet cassette 70, a first, e.g., a particular, rotating member, e.g., a pickup roller 25, a second, e.g., a further, rotating member, e.g., a feed roller 50, and a moving device, e.g., a moving mechanism 54.

Figure 4:
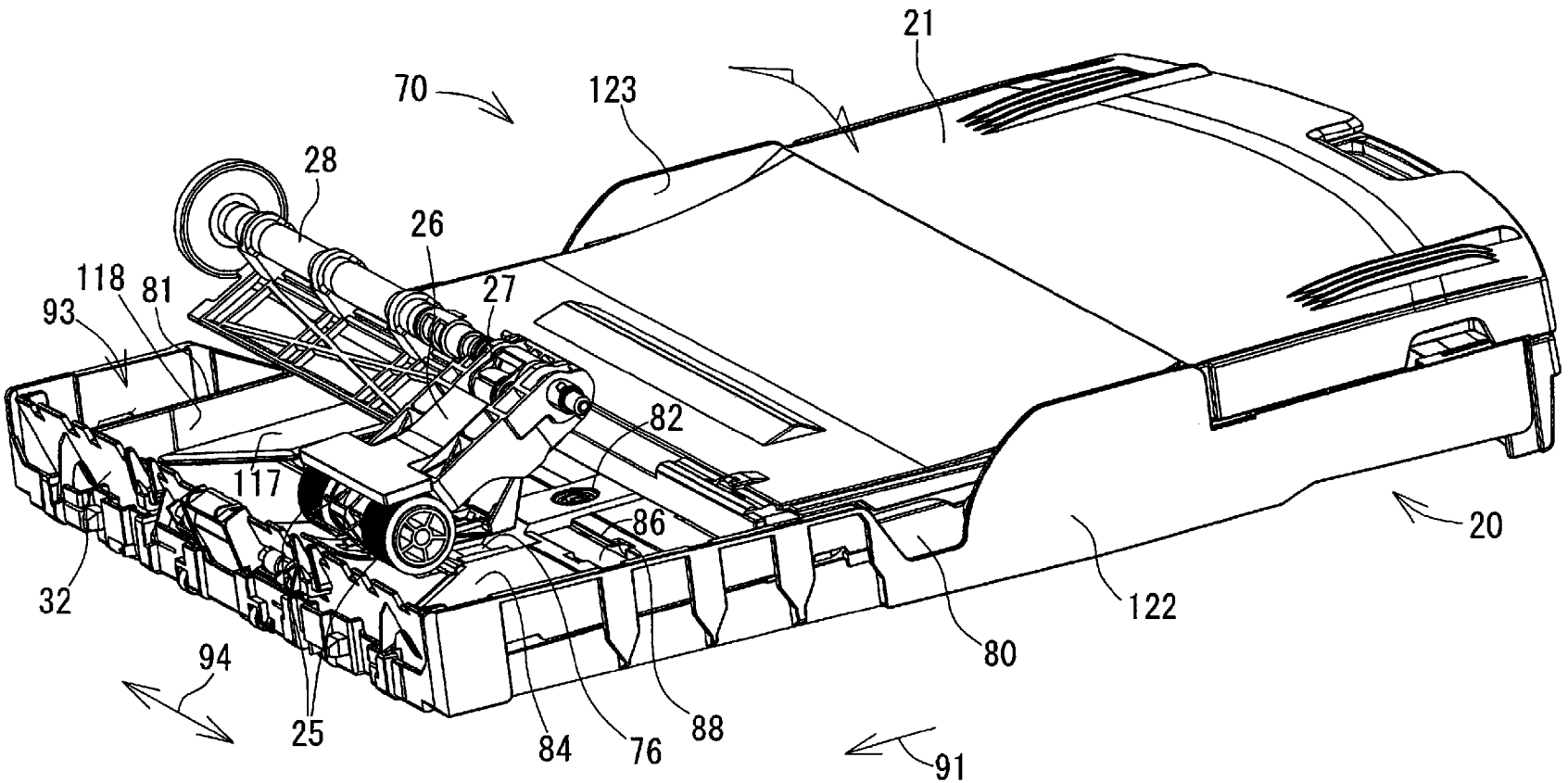
FIG. 4 is a perspective view of a sheet cassette, according to an embodiment.
Figure 5:
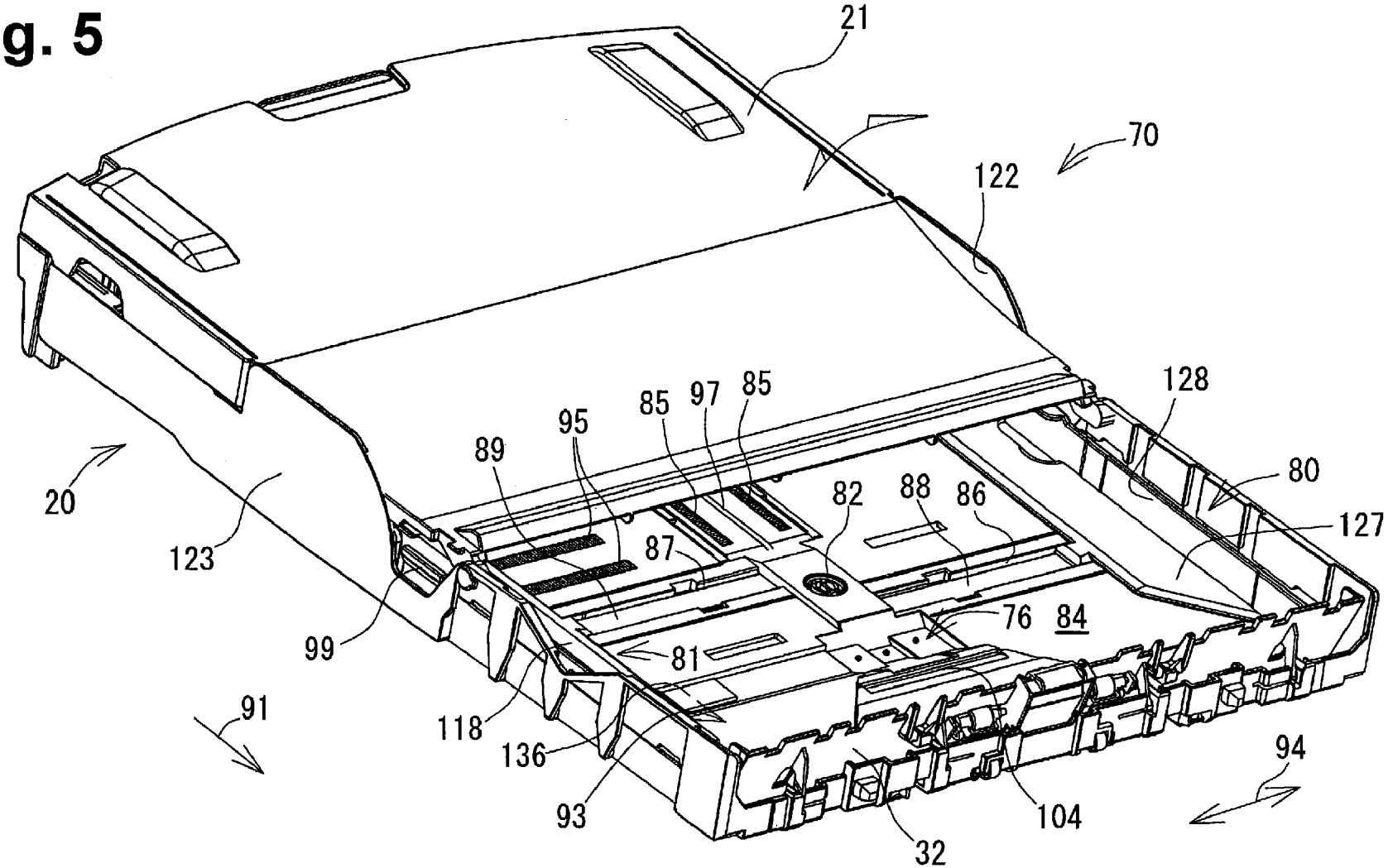
FIG. 5 is a perspective view of the sheet cassette in which a pickup roller and an arm are removed, according to an embodiment.

Sheet cassette 70 may be configured to be inserted through opening 13 into printer section 11 in an insertion direction 90, or to be removed from printer section 11 in a removal direction 92. Sheet cassette 70 may comprise a sheet feed tray 20 and a sheet output tray 21. Referring to FIGS. 4 and 5, recording sheets may be placed on a bottom plate 84 of sheet feed tray 20. Sheet feed tray 20 may be configured to hold a stack of recording sheets. Recording sheets having an image formed thereon may be output on sheet output tray 21. Insertion direction 90 may correspond to a direction 91 in which a recording sheet held in sheet feed tray 20 may be conveyed in a sheet feeding path 22.

Referring again to FIGS. 1-3, pickup rollers 25 may be positioned at an upper portion of sheet feed tray 70 when sheet cassette 70 is inserted into printer section 11. Pickup rollers 25 may be configured to feed recording sheets on sheet feed tray 20 to sheet feeding path 22. A supporting member, e.g., an arm 26 may be positioned above sheet feed tray 20. Pickup rollers 25 may be rotatably positioned at an end of arm 26. A drive source, e.g., a motor (not shown) may transmit a drive force to pickup rollers 25 via a drive force transmitting mechanism 27, which may be supported by arm 26. Upon receiving the drive force, pickup rollers 25 may rotate. Drive force transmitting mechanism 27 may comprise a plurality of gears that may be engaged in line.

A base end portion of arm 26 may be supported by a shaft 28. Arm 26 may pivot about shaft 28 in a direction away from or close to sheet feed tray 20. Pickup rollers 25 positioned at an end of arm 26 may move away from or close to sheet feed tray 20 based on the pivotal movement of arm 26. Arm 26 may be pivotally urged downward, for example, by the weights of arm 26 and pickup rollers 25 or a spring.

As arm 26 is pivotally urged downward, pickup rollers 25 may be pressed against recording sheets held in sheet feed tray 20 at a predetermined pressure. In this state, as pickup rollers 25 rotate, an uppermost sheet in sheet feed tray 20 may be fed in sheet feeding direction 91 by frictional force between roller surfaces of pickup rollers 25 and the recording sheets. An inclined plate 32 may be positioned at a downstream end of sheet feed tray 20 in the sheet feeding direction 91. When a leading end of a recording sheet contacts inclined plate 32, inclined plate 32 may guide the recording sheet upward in the sheet feeding direction 91, to sheet feeding path 22 formed above incline plate 32.

Pickup rollers 25 optionally do not have to be supported by arm 26 if pickup rollers 25 are configured to move away from and close to sheet feed tray 20. For example, pickup rollers 25 may be supported by a frame of sheet feed tray 20 so as to move up and down. Referring to FIGS. 4 and 5, moving mechanism 54 may be connected to arm 26. A portion of moving mechanism 54, e.g., a particular operative portion 68 may be configured to move into a recess 76, which may be formed in bottom plate 84 of sheet feed tray 20. As particular operative portion 68 moves into recess 76, arm 26 may be raised such that pickup rollers 25 move away from bottom plate 84 of sheet feed tray 20. Moving mechanism 54 will be discussed in more detail herein.

A separation member 34 may be positioned on an inner surface of inclined plate 32 at a middle portion of inclined plate 32 in its longitudinal direction. Separation member 34 may comprise a plurality of teeth extending from the inner surface. The plurality of teeth may be positioned in sheet feeding direction 91. If a plurality of recording sheets are fed simultaneously, e.g., multiple feeding, is performed, leading ends of a plurality of recording sheets may contact the inner surface of inclined plate 32. The teeth of separation member 34 may enter between the recording sheets to provide a gap therebetween, which may separate the leading ends of a plurality of recording sheets by separation member 34. In combination with a force applied to the recording sheets from pickup rollers 25 during sheet feeding, the uppermost sheet reliably may be separated from the remaining sheets. In other embodiments, separation member 34 may be omitted. Nevertheless, in the illustrated embodiment, separation member 34 may be provided to assist recording sheet separation by pickup rollers 25.

Sheet feeding path 22 may be formed above inclined plate 34. More specifically, sheet feeding path 22 may extend upward from inclined plate 34 and curve frontward of printer section 11, e.g., the right side when MFD 10 is positioned as shown in FIG. 2, forming a "U" shape. Sheet feeding path 22 may further extend from a rear side, e.g., the left side when MFD 10 is positioned as shown in FIG. 2, of MFD 10 to a front side thereof, to sheet output tray 21 through recording unit 24, as shown in FIG. 3, e.g., sheet output tray 21 may be positioned on downstream side of sheet feeding path 22 in the sheet feeding direction 91. Recording sheets fed from sheet feed tray 20 may be conveyed to a recording unit 24 while being guided, such that the recording sheets may make a U-turn, e.g., change absolute direction, from the lower side to the upper side of MFD 10 along sheet feeding path 22. Recording unit 24 may record images on the conveyed recording sheets and thereafter the recording sheets may be output onto sheet output tray 21.

Sheet feeding path 22 may be defined by inner and outer guide surfaces and an additional portion not defined by inner and outer guide surfaces, e.g., a portion where recording unit 24 is positioned. For example, a curved portion of sheet feeding path 22 positioned on a rear side of MFD 10 may be formed with an outer guide member 18 and an inner guide member 19. Outer guide member 18 and inner guide member 18 may be positioned with a predetermined distance therebetween. Outer guide member 18 may function as an outer curved-guide surface. Inner guide member 19 may function as an inner curved-guide surface.

Referring to FIG. 2, recording unit 24 may be positioned at a portion of sheet feeding path 22 between the rear side and the front side of printer section 11. Recording unit 24 may be configured to record images on recording sheets while recording sheets are conveyed in sheet feeding path 22. Referring to FIG. 3, recording unit 24 may comprise a carriage 40 and an inkjet recording head (not shown) mounted on carriage 40. Carriage 40 may be configured to reciprocate along guide rails 43, 44 in a width, e.g., lateral, direction of the recording sheets, e.g., a direction perpendicular to a sheet of FIG. 2. Referring to FIG. 3, a belt drive mechanism 39 driven by a drive source, e.g., a motor 73 may be positioned on guide rail 44. Belt drive mechanism 39 may comprise a drive pulley 47 and a driven pulley 48 positioned at each end of guide rail 44 in the longitudinal direction of guide rail 44. An endless belt may be looped around drive pulley 47 and driven pulley 48. Carriage 40 may be connected to the belt of belt drive mechanism 39, such that drive force from motor 73 connected to drive pulley 47 may be transmitted to carriage 40 via belt drive mechanism 39. Thus, carriage 40 may be reciprocated.

A platen 42 that faces a lower surface of recording unit 24 may be positioned in sheet feeding path 22. Platen 42 may be configured to support a recording sheet conveyed in sheet feeding path 22 from below, with a predetermined gap between the recording sheet and the recording head. Ink cartridges (not shown), each storing ink of different color, may be positioned inside MFD 10 independently of the recording head. Ink contained each ink cartridge may be supplied to the recording head via an ink tube. While carriage 40 reciprocates, each color ink may be selectively ejected as small ink droplets from the recording head toward platen 42. While a recording sheet is being fed on platen 42, recording unit 24 may record an image on the recording sheet.

Referring to FIGS. 2 and 3, feed roller 50 may be positioned downstream of pickup rollers 25 and upstream of recording unit 24 in the sheet feeding direction 91. Pinch rollers (not shown) may be positioned below feed roller 50, such that the pinch rollers may contact feed roller 50. Feed roller 50 may extend in a width, e.g., lateral, direction of sheet feeding path 22. Pinch rollers may be positioned with a predetermined distance therebetween in the width, e.g., lateral, direction of sheet feeding path 22. Feed roller 50 and the pinch rollers may hold a recording sheet fed from sheet cassette 70 by pickup rollers 25, and may feed the sheet onto platen 42.

Figure 6:
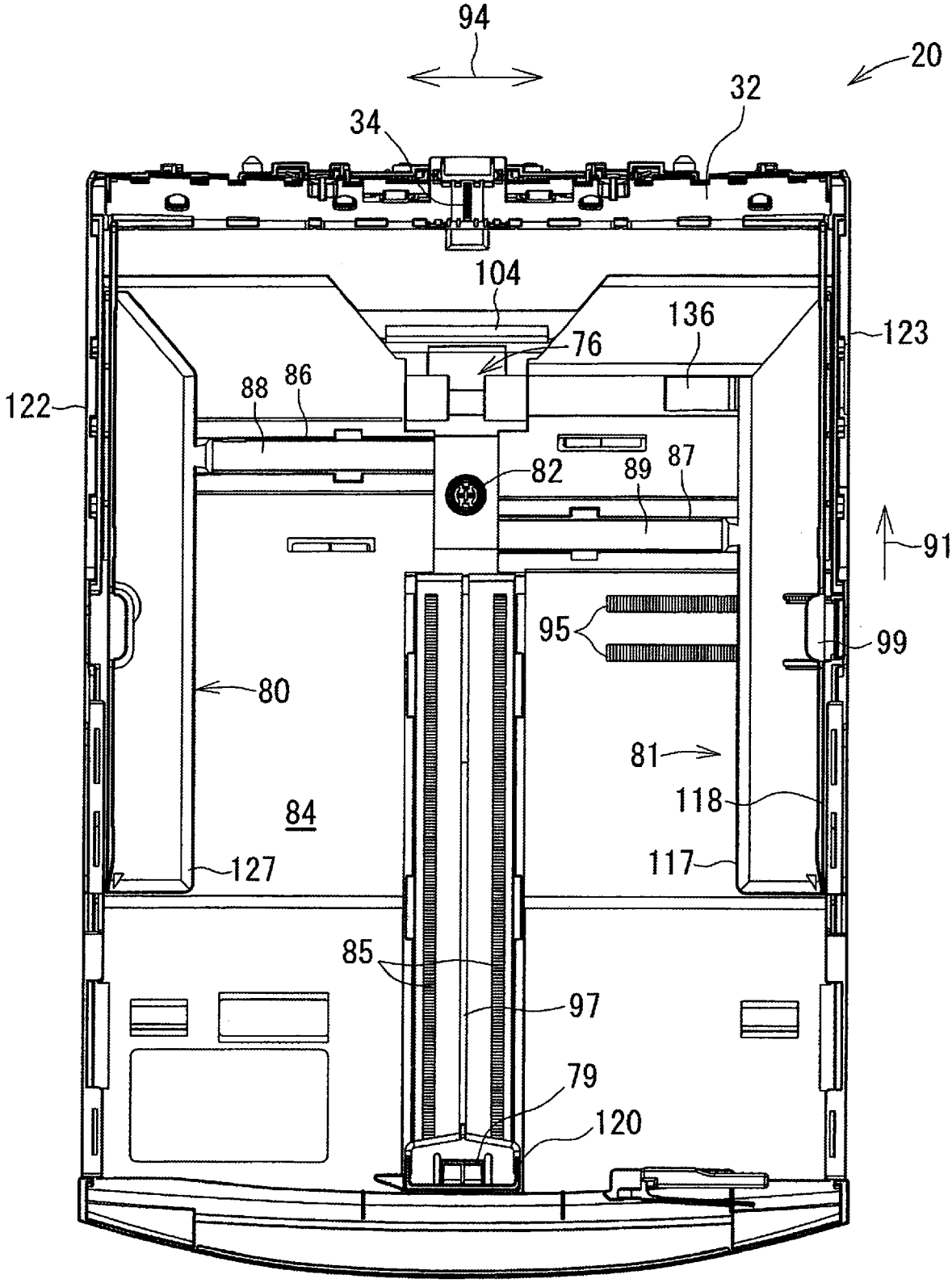
FIG. 6 is a plan view of the sheet cassette in which side guides are in a first bottom position to position sheets of sizes larger than a minimum size handled by the image recording apparatus, according to an embodiment.

Feed roller 50 may be positioned such that a length of the sheet feeding path from pickup rollers 25 to feed roller 50 corresponds to a minimum size of, e.g., length of, a recording sheet loadable to sheet feed tray 20. In an embodiment, a minimum size of a recording sheet may be a standard photo size. More specifically, the length of the sheet feeding path from pickup rollers 25 to feed roller 50 may be slightly shorter than the length dimension of a minimum-size recording sheet in sheet feeding direction 91, e.g., length of a standard photo-size sheet. As shown in FIGS. 5 and 6, the length of the sheet feeding path from recess 76 to feed roller 50 may be set slightly longer than the length dimension of the minimum-size recording sheet in sheet feeding direction 91. In other words, the dimension of the minimum-size recording sheet, e.g., standard photo-size sheet, may be longer than the length of sheet feeding path from pickup rollers 25 to feed roller 50 and shorter than the length of the sheet feeding path from recess 76 to feed roller 50. Therefore, when a minimum-size recording sheet is fed by pickup rollers 25, and fed to sheet feeding path 22, and its trailing end passes over recess 76, the leading end of the recording sheet may not reach feed roller 50. When the trailing end of the minimum-size recording sheet passes pickup rollers 25, the leading end of the recording sheet may be held by feed roller 50.

Output roller 51 and a plurality of spurs (not shown) may be positioned downstream of recording unit 24 in sheet feeding path 22. The spurs may be positioned above output roller 51 and pressed against output roller 51. Output roller 51 may extend in the width, e.g., lateral, direction of sheet feeding path 22, e.g., the direction perpendicular or intersecting the sheet feeding direction 91. The spurs may be positioned such that a predetermined distance exists therebetween in the width, e.g., lateral, direction of sheet feeding path 22. A recording sheet having an image recorded thereon may be conveyed toward sheet output tray 21 while being held between output roller 51 and the spurs. A drive source, e.g., a motor (not shown), may drive feed roller 50 and output roller 51 in synchronization with each other. Feed roller 50 and output roller 51 may be driven intermittently during image recording and also may be substantially continuously driven before and after image recording. Thus, a recording sheet may be fed at a predetermined speed until the recording sheet reaches recording unit 24. When the recording sheet reaches recording unit 24, the recording sheet may be fed intermittently by a predetermined width, e.g., a predetermined line feed width. While the recording sheet is being fed intermittently, carriage 40 may reciprocate and recording head may record an image at a predetermined position on the recording sheet.

Referring to FIGS. 4 and 5, sheet cassette 70 generally may have a thin rectangular parallelepiped shape. Sheet cassette 70 may comprise sheet feed tray 20 and sheet output tray 21. Sheet feed tray 20 and sheet output tray 21 may be vertically disposed in a stepped manner, and sheet output tray 21 may be above sheet feed tray 20. Recording sheets in sheet feed tray 20 may be conveyed in sheet feeding direction 91. An upper portion of sheet cassette 70 at a downstream end with respect to sheet feeding direction 91, may have an open portion 93 configured to lead pickup rollers 25 to sheet feed tray 20. When sheet cassette 70 is inserted into printer section 11, open portion 93 may be positioned below arm 26 and pickup rollers 25. At this time, arm 26 and pickup rollers 25 may be guided through open portion 93 toward sheet feed tray 20, such that pickup rollers 25 may be pressed against bottom plate 84 of sheet feed tray 20. Pickup rollers 25 may contact an upper surface of the uppermost recording sheet when recording sheets are loaded in sheet feed tray 20.

Sheet output tray 21 may be configured to pivotally move with respect to sheet feed tray 20, and width direction 94 may act as a pivot. When sheet output tray 21 is pivotally moved upward with respect to sheet feed tray 20, the upper portion of sheet feed tray 20 may open. Thus, recording sheets may be loaded to sheet feed tray 20. When sheet output tray 21 is laid down onto sheet feed tray 20, the upper end of sheet feed tray 20 may be covered with sheet output tray 21. Referring to FIGS. 4 and 5, sheet feed tray 20 may have a rectangular tray shape, when viewed in a plan view. Sheet feed tray 20 may accommodate recording sheets of various sizes. Sheet feed tray 20 may comprise side walls 122, 123 positioned at each end of sheet feed tray 20 in width direction 94. Side walls 122, 123 may extend upwardly from and perpendicular to bottom plate 84.

Widthwise, e.g., lateral, sizes of recording sheets loadable onto sheet feed tray 20 generally may be determined by side walls 122, 123. In an embodiment, sheet feed tray 20 may be configured to accommodate various sizes of recording sheets, e.g., those recording sheet sizes specified in Japanese Industrial Standards ("JIS"), e.g., A4, B5, A5, postcard and standard photo sizes. In an embodiment, the maximum and minimum sizes of recording sheets to be loadable in sheet feed tray 20 may be A4 size and standard photo size, respectively. Nevertheless, the maximum and minimum sizes of recording sheets to be loadable in sheet feed tray 20 may not be limited to A4 size and standard photo size, respectively. For example, in another embodiment, sheet feed tray 20 may be configured to accommodate recording sheets with sizes ranging from business card size as a minimum size to A3 as a maximum size.

Referring to FIGS. 5 and 6, a friction member, e.g., a friction pad 104, may be positioned on bottom plate 84 of sheet feed tray 20 at a middle portion in width direction 94. Friction pad 104 may contact the roller surface of pickup rollers 25 and may aid separation of recording sheets. Friction pad 104 may have a friction coefficient greater than that of bottom plate 84. Friction pad 104 may be formed of material, e.g., cork or rubber, into a thin plate shape. When sheet cassette 70 is inserted into printer section 11 with no recording sheets held in sheet feed tray 20, arm 26 and pickup rollers 25 may be positioned on sheet feed tray 20. At this time, arm 26 may pivot toward sheet feed tray 20, and pickup rollers 25 may move toward sheet feed tray 20 and contact friction pad 104.

Friction pad 104 may have rectangular shape elongated in the same direction as an axial direction of pickup rollers 25. The length of friction pad 104 may be longer than the length of pickup rollers 25 in its axial direction. As shown in FIG. 4, in an embodiment in which two pickup rollers 25 are disposed along an axial direction of friction pad 104, friction pad 104 may have a length corresponding to the length of two pickup rollers 25.

When sheet cassette 70 is inserted into printer section 11 with recording sheets held in sheet feed tray 20, pickup rollers 25 may be pressed against the recording sheets held in sheet feed tray 20. Thus, the recording sheets may be held between friction pad 104 and pickup rollers 25. When pickup rollers 25 rotate to feed the recording sheets in sheet feeding direction 91, a frictional force in sheet feeding direction 91 may be applied from pickup rollers 25 to the uppermost recording sheet of a stack of recording sheets, which may be positioned between friction pad 104 and pickup rollers 25. With respect to other recording sheets which may be disposed below the uppermost recording sheet, a frictional force in the direction opposite to sheet feeding direction 91 may be applied between the recording sheets, or between friction pad 104 and the recording sheet.

Referring to FIGS. 5 and 6, recess 76 may be positioned at a portion substantially in the middle of bottom plate 84 in width direction 94. Recess 76 may be positioned at the same position as friction pad 104 with respect to width direction 94, and upstream of friction pad 104 in sheet feeding direction 91, e.g., recess 76 may be positioned upstream of pickup rollers 25 in sheet feeding direction 91. Recess 76 may be positioned where particular operative portion 68 moves into recess 76. Recess 76 may be covered by recording sheets when recording sheets are placed on bottom plate 84 of sheet feed tray 20. Recess 76 may be uncovered and open upward when recording sheets are not placed on bottom plate 84.

Referring to FIG. 6, bottom plate 84 may comprise a pair of guide grooves 86, 87 extending in width direction 94. Guide grooves 86, 87 may have a rectangular shape, and may be elongated in width direction 94. Guide grooves 86, 87 may be formed through bottom plate 84 from its upper surface to its lower surface. Guide grooves 86, 87 may be positioned apart in sheet feeding direction 91. A pinion gear 82 may be positioned on bottom plate 84 at a portion substantially in the middle of bottom plate 84 in width direction 94, and upstream of recess 76 in sheet feeding direction 91. Pinion gear 82 may be positioned between guide grooves 86, 87. Pinion gear 82 may engage with rack gears 88, 89 positioned on a bottom surface of bottom plate 84.

Figure 7:
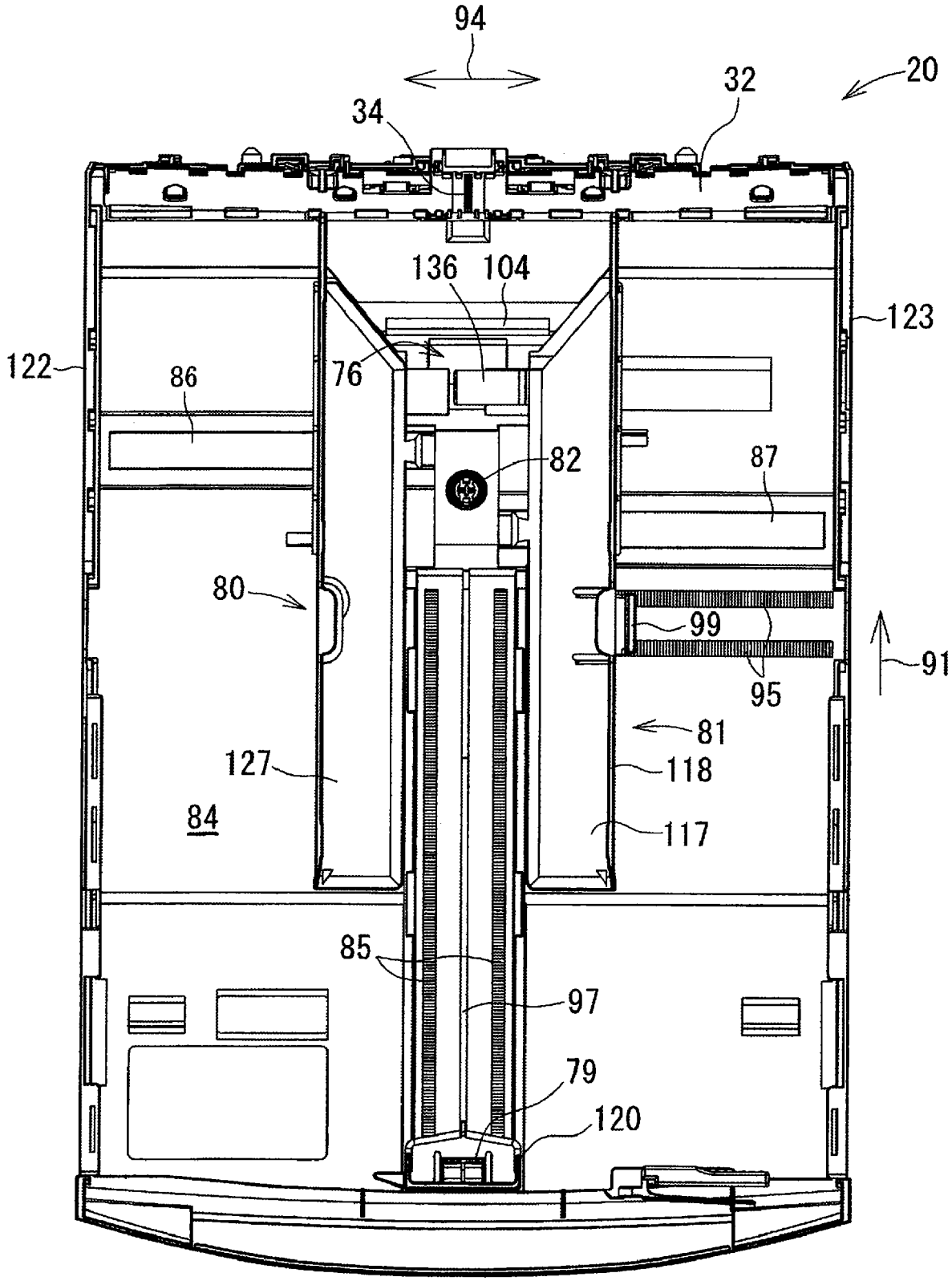
FIG. 7 is a plan view of the sheet cassette in which the side guides are in a second bottom position, e.g., to position sheets of the minimum size, according to an embodiment.

Referring to FIGS. 5-7, a pair of side guides 80, 81 may be positioned on sheet feed tray 20. Side guides 80, 81 may be formed of synthetic resin material, e.g., acrylonitrile butadiene styrene ("ABS") resin. Each side guide 80, 81 may have a substantially "L" shape when viewed in a cross sectional view taken along width direction 94. Side guides 80, 81 may be configured to move with respect to sheet feed tray 20. Side guides 80, 81 may be slidably supported by bottom plate 84 along guide grooves 86, 87, respectively.

Side guides 80, 81 may be configured to position recording sheets with respect to sheet feed tray 20. As side guides 80, 81 move, ends of recording sheets, in width direction 94, held in sheet feed tray 20 may contact vertical walls 118, 128. Thus, positions of the recording sheets, which may be loaded onto sheet feed tray 20, with respect to width direction 94 may be restricted by side guides 80, 81. More specifically, sheet guides 80, 81 may regulate the positions of recording sheets loaded onto sheet feed tray 20, such that sheet guides 80, 81 substantially may align a center of the recording sheets with respect to the recording sheets' width, e.g., lateral, direction, with a predetermined reference position, e.g., the center of sheet feed tray 20 in its width, e.g., lateral, direction. The recording sheets loaded onto sheet feed tray 20 may be fed in sheet feeding direction 91 to sheet feeding path 22 while being guided by side guides 80, 81. Sheet guides 81, 82 further may position various sizes of recording sheets.

Referring to FIGS. 4-7, a positioning member, e.g., side guide 81 may comprise a first plate, e.g., a bottom wall 117 and a second plate, e.g., vertical wall 118. Bottom wall 117 may be positioned parallel to bottom plate 84 of sheet feed tray 20. Bottom wall 117 may support one end of the recording sheets with respect to their width, e.g., lateral, direction from the lower side of the recording sheets. Vertical wall 118 may extend upward from an outer edge of bottom wall 117 with respect to its width direction, perpendicular to bottom wall 117. With the recording sheets loaded onto bottom wall 117, one edge of the recording sheets with respect to their width, e.g., lateral, direction may contact the inner surface of vertical wall 118. Thus, the edges of the recording sheets in width direction 94 may contact side guide 81.

Vertical wall 118 may comprise a lever 99. Lever 99 may be integrally formed with side guide 81 with the same resin material. A plurality of engagement portions 95 may be formed on the surface of bottom plate 84. The longitudinal direction of each engagement portion 95 may correspond to sheet feeding direction 91. Engagement portions 95 may be arranged along width direction 94. In this embodiment, two rows of a plurality of engagement portions 95 may be formed on bottom plate 84. Lever 99 may comprise a plurality of, e.g., two, catches (not shown) positioned at positions which correspond to a plurality of, e.g., two, rows of engagement portions 95. When the catches engage with any engagement portions 95 of the rows, side guide 81 may be fixed to bottom plate 84. When a user operates lever 99, the catches may be raised. The catches may be removed from engagement portions 95, and side guide 81 may be unfixed from bottom plate 84. In this position, side guide 81 may slidably move.

As shown in FIG. 6, side guide 81 may comprise rack gear 89 extending from bottom wall 117 toward the middle portion of sheet feed tray 20 in width direction 94. Rack gear 89 may be positioned on the rear side of bottom plate 84 via guide groove 87 and engage with pinion gear 82. Referring to FIGS. 6 and 7, a restriction member, e.g., a plate 136 may be positioned at bottom wall 117 of side guide 81. Plate 136 may extend from bottom wall 117 in the movement direction of side guide 81 toward the middle portion of sheet feed tray 20 in width direction 94. Plate 136 may be a flat plate member, and a longitudinal direction of plate 136 corresponds to width direction 94. Plate 136 may extend in a direction parallel to bottom plate 84, similar to bottom wall 117.

Plate 136 may be disposed at substantially the same position as recess 76 with respect to sheet feeding direction 91. When side plate 81 moves, plate 136 may move in the same direction as side plate 81. As shown in FIG. 6, when side guide 81 is moved to a first portion to position recording sheets of a size, e.g., postcards, larger than a standard photo size, plate 136 may be positioned away from, e.g., at a position that does not cover, recess 76. As shown in FIG. 7, when side guide 81 is moved to a second portion to position recording sheets of a standard photo size, plate 136 may be positioned above recess 76 so as to cover recess 76, or a portion of recess 76.

Side guide 80 may be formed symmetrically with side plate 81, except that side guide 80 may not comprise lever 99 and plate 136. Similar to side guide 81, side guide 80 may comprise a bottom wall 127 and vertical wall 128. Opposite edges of the recording sheets in their width, e.g., lateral, direction may be placed on bottom wall 127. Vertical wall 128 may extend upward from an outer edge of bottom wall 127 with respect to its width direction, perpendicular to bottom wall 127. With the recording sheets loaded onto bottom wall 127, the opposite edges of the recording sheets with respect to their width, e.g., lateral, direction may contact the inner surface of vertical wall 128.

Side guide 80 may comprise a rack gear 88 configured similar to rack gear 89. Rack gear 88 may be positioned on the rear side of bottom plate 84 via guide groove 86 and engage with pinion gear 82. As one of side guides 80, 81, e.g., side guide 81, is slidably moved in width direction 94, the other side guide, e.g., side guide 80, also may be slidably moved in the opposite direction. When the width, e.g., lateral, direction of recording sheets loaded onto sheet feed tray 20 is shorter than the distance between side guides 80, 81, both side guides 80, 81 simultaneously may be moved by sliding one of side guides 80, 81, to align the center of the recording sheets in their width, e.g., lateral, direction with the reference position.

In an embodiment of the invention, one of side guides 80, 81 may be slidably configured, and the other may be stationary. For example, side guides 80, 81 may be configured such that only side guide 81 slidably moves and side guide 80 is fixed to the position shown in FIG. 6.

Rear guide 120 may be positioned in the middle of sheet feed tray 20 in width direction 94. Rear guide 120 may position recording sheets with respect to sheet feed tray 20. Rear guide 120 may contact upstream ends of recording sheets, which may be loaded onto sheet feed tray 20, in sheet feeding direction 91. Rear guide 120 may restrict the movement of recording sheets, which may be loaded onto sheet feed tray 20, in the direction opposite to sheet feeding direction 91.

Rear guide 120 may be configured to move in sheet feed tray 20. More specifically, rear guide 120 may be moved in sheet feeding direction 91 and its opposite direction in sheet feed tray 20. Bottom plate 84 may have a groove 97 elongated in sheet feeding direction 91 from a portion substantially in the middle of sheet feed tray 20 in its longitudinal direction to the upstream end of sheet feed tray 20 in sheet feeding direction 91. Rear guide 120 may be positioned in sheet feed tray 20 to slidably move along groove 97.

A plurality of engagement portions 85 may be positioned on each side of groove 97. The longitudinal direction of each engagement portion 85 may correspond to a direction perpendicular to groove 97. Rear guide 120 may comprise a plurality of, e.g., two, catches (not shown) that removably fit to engagement portions 85 which may be positioned at each side of groove 97. Rear guide 120 may be integrally formed with a lever 79 with a resin material, e.g., the same resin material as in side guides 80, 81. As the catches of rear guide 120 engage with engagement portions 85, rear guide 120 may be fixed to bottom plate 84. When a user operates lever 79, the catches of rear guide 120 may be raised. Accordingly, the catches may be removed from engagement portions 85 and rear guide 120 may be unfixed from bottom plate 84 so as to slidably move.

When rear guide 120 is slidably moved along groove 97 in sheet feeding direction 91 with recording sheets loaded onto sheet feed tray 20, rear guide 120 may contact trailing ends of the recording sheets. With rear guide 120, upstream ends of the recording sheets in sheet feeding direction 91 may be aligned and positioned at a location corresponding to the sizes of the recording sheets. The downstream ends of the recording sheets in sheet feeding direction 91 may be placed at a predetermined position adjacent to inclined plate 32 in sheet feed tray 20, regardless of the sizes of the recording sheets in sheet feed tray 20.

Figure 8:
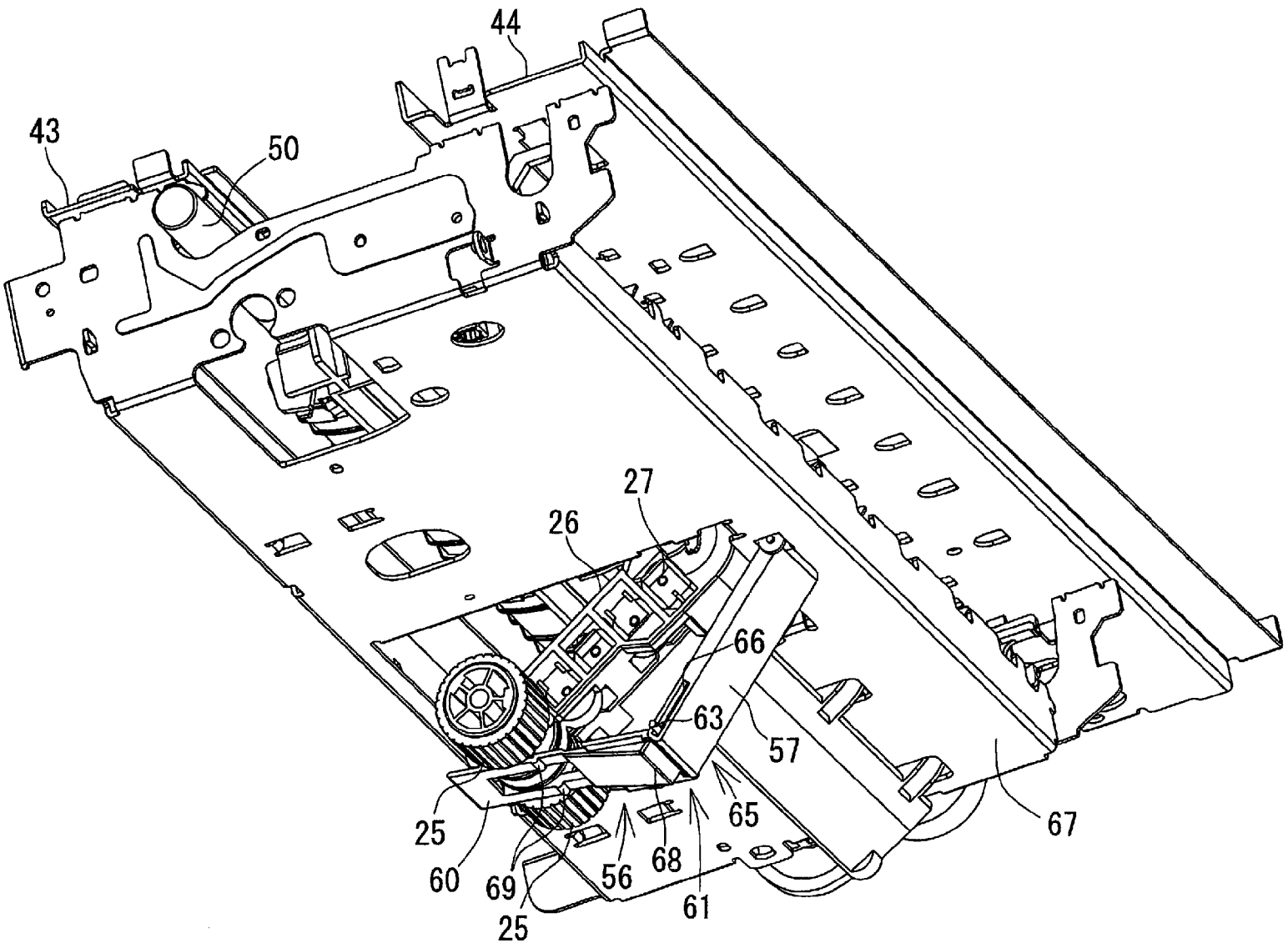
FIG. 8 is a perspective view of a moving mechanism according to an embodiment.

Referring to FIG. 8, moving mechanism 54 may comprise an operative member, e.g., a main operative member 56, and a supporting operative member 57. Main operative member 56 may comprise a downstream end 60 and an upstream end 61 in sheet feeding direction 91. As shown in FIG. 2, downstream end 60 may pivotally move in the vertical direction about a shaft 59 that may be positioned at a lower portion of an of arm 26. Downstream end 60 may extend in a downstream side in sheet feeding direction 91 from shaft 59. Upstream end 61 may extend in an upstream side in sheet feeding direction 91 from shaft 59. Supporting operative member 57 may be pivotally supported about its upper end by a frame 67 of printer section 11.

Main operative member 56 may comprise a pin 63 that may be positioned at upstream end 61 of main operative member 56 in sheet feeding direction 91. Pin 63 may be inserted into an elongated slot 66, which may be formed at a lower part 65 of supporting operative member 57. Main operative member 56 and supporting operative member 57 may be connected such that main operating member 56 and supporting operative member 57 bend at pin 63, and also such that main operating member 56 and supporting operative member 57 may move upward and downward.

Main operative member 56 may comprise a particular operative portion 68 and a further operative portion 69. Particular operative portion 68 may be positioned at a lower surface of the upstream side of main operative member 56 in sheet feeding direction 91. When recording sheets are loaded onto sheet feed tray 20, particular operative portion 68 may not contact the upper surface of a stack of the recording sheets. When recording sheets are not loaded onto sheet feed tray 20, particular operative portion 68 may move into recess 76, which may be open in bottom plate 84. Particular operative portion 68 may be positioned and aligned such that particular operative portion 68 may selectively move into recess 76 and retract from recess 76 in an upward direction. Further operative portion 69 may be positioned downstream of particular operative portion 68 in sheet feeding direction 91, at a lower surface of the downstream side of main operative member 56.

In an embodiment, weights of a portion of main operative member 56 on the side of particular operative portion 68 and supporting operative member 57 may be greater than the weight of a portion of main operative member 56 on the side of downstream end 60. More specifically, weights of a portion of main operative member 56 on the side of particular operative portion 68 and supporting operative member 57 may be set to a predetermined weight, such that when there are no more recording sheets contacting bottom plate 84 of sheet feed tray 20, particular operative portion 68 may move into recess 76 and in turn, further operative portion 69 may contact the upper surface of bottom plate 84. This may cause arms 26 to be raised, with further operative portion 69 as a fulcrum, which may move pickup rollers 25 away from bottom plate 84 by the weight of a portion of main operative member 56 on the side of particular operative portion 68 and supporting operative member 57.

Figure 9A:
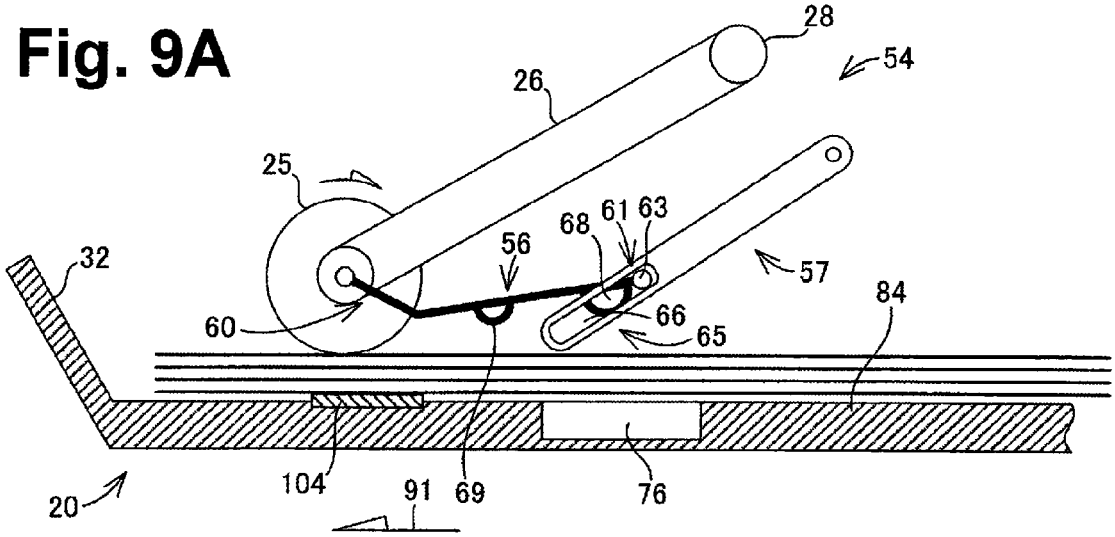
FIGS. 9A-9C are cross-sectional views of the moving mechanism showing operations thereof, according to an embodiment.

Referring to FIG. 9A, when a stack of recording sheets with a size larger than a minimum size, e.g., a standard photo size, are loaded in sheet feed tray 20, pickup rollers 25 may be pressed against the uppermost recording sheet. At this time, lower part 65 of supporting operative member 57 may contact the uppermost sheet, depending on an amount of recording sheets stacked in sheet feed tray 20. First and second, e.g., particular and further, operative portions 68, 69 of main operative member 56 may not contact the uppermost sheet. Lower part 65 may not contact the uppermost sheet, but particular operative portion 68 may contact the uppermost sheet, depending upon an amount of recording sheets stacked in sheet feed tray 20, e.g., the amount of space taken up by recording sheets stacked in sheet feed tray 20. Further operative portion 69 may not contact the uppermost sheet, e.g., there may be a space between further operative portion 69 and the uppermost sheet, independent of the number of recording sheets stacked in sheet feed tray 20, when recording sheets are on sheet feed tray 20.

Referring to FIG. 9A, as an instruction of sheet feeding is entered when recording sheets are loaded onto sheet feed tray 20, shaft 28 may rotate in a predetermined direction and pickup rollers 25 may be rotated clockwise in FIG. 9A, via drive force transmitting mechanism 27, e.g., as shown in FIG. 2. As shown in FIG. 2, a recording sheet in sheet feed tray 20 may be fed in sheet feeding direction 91. The recording sheet may contact inclined plate 32 and may be fed to sheet feeding path 22 while making a U-turn.

Figure 9B:
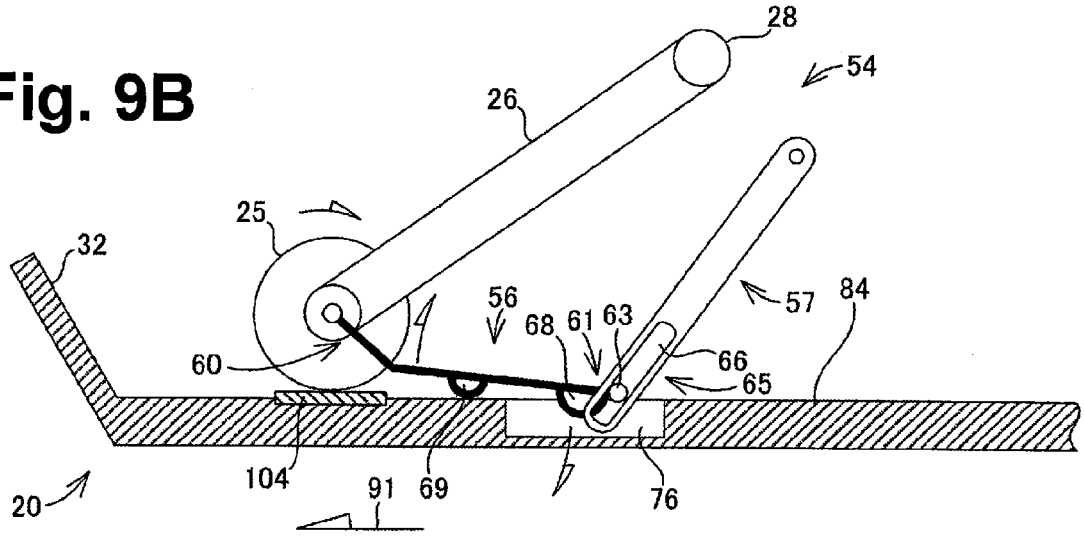
Figure 9C:
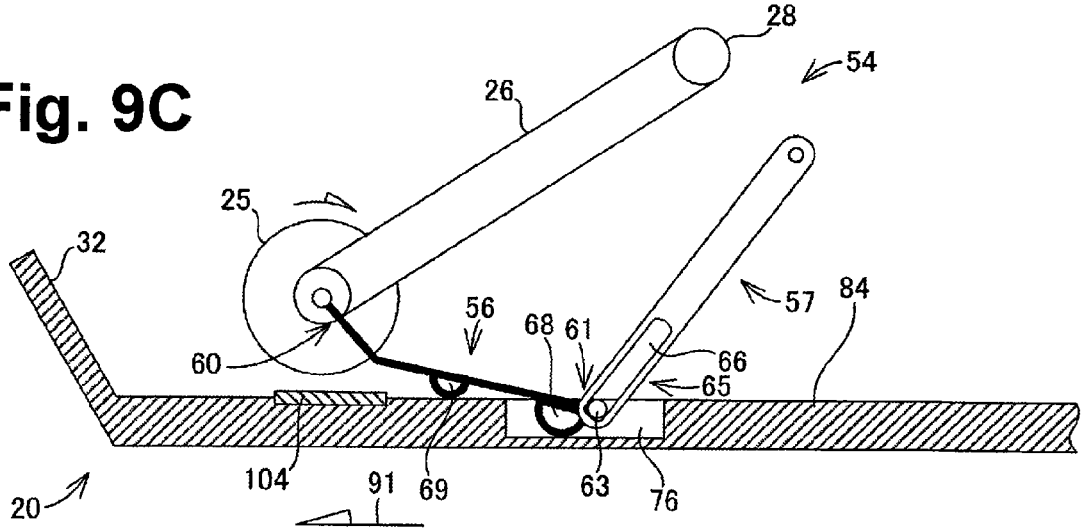

Referring to FIG. 9B, when the last remaining recording sheet is fed and its trailing end passes over recess 76, recess 76 may be uncovered in bottom plate 84. When recess 76 is uncovered, particular operative portion 68 may move into recess 76. When recess 76 becomes uncovered, lower part 65 of supporting operative member 57 may move into recess 76. Then, second operative member 69 may contact the upper surface of bottom plate 84. Thereafter, first operative portion 86 may be lowered by the weight of a portion of main operative member 56 on the side of particular operative portion 68 and supporting operative member 57, and may move into recess 76. As shown in FIG. 9C, when particular operative portion 68 moves into recess 76, particular operative portion 68 may raise arm 26, which may move pickup rollers 25 away from bottom plate 84. When pickup rollers 25 are rotated in a direction to feed recording sheets, with no recording sheets loaded onto sheet feed tray 20, pickup rollers 25 may not contact friction pad 104, such that the roller surfaces of pickup rollers 25 may not be worn out. Further, problems, such friction pad 104 locking the rotation of pickup rollers 25, thereby overheating the motor due to excessive load applied to the motor, may be solved.

Figure 10:
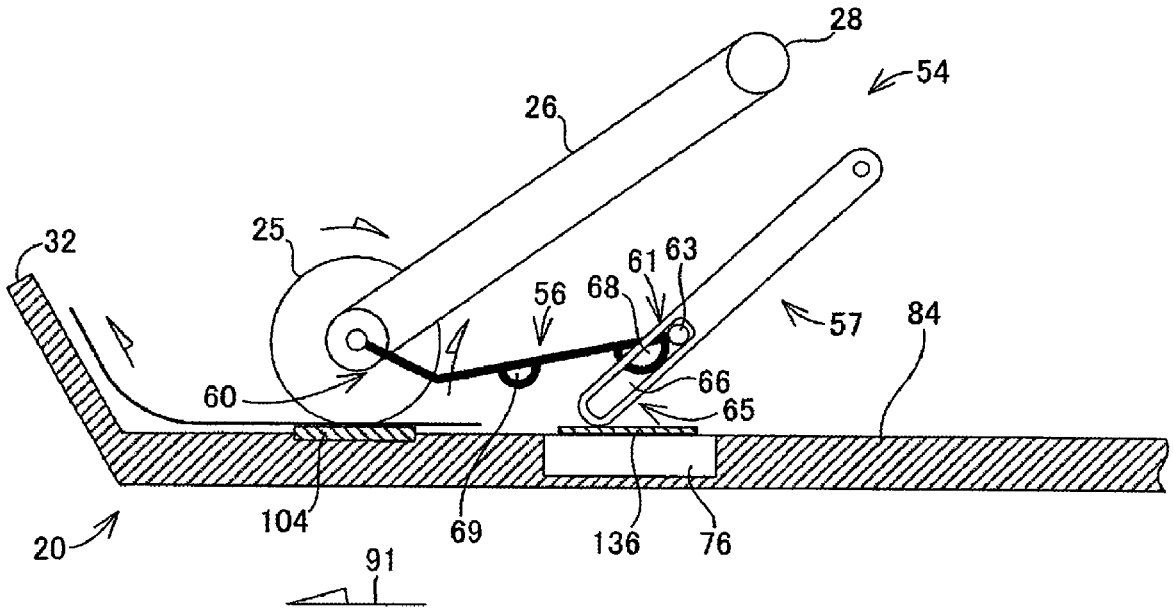
FIG. 10 is a cross-sectional view of the moving mechanism showing operations thereof, according to an embodiment.

Referring to FIG. 10, when the minimum size of recording sheets are loaded onto sheet feed tray 20, side guides 80, 81 may be moved to the second bottom position, and recess 76, or a portion of recess 76, may be covered with plate 136. When the last remaining recording sheet on sheet feed tray 20 is fed and its trailing end passes over recess 76, recess 76 may not be uncovered in bottom plate 84. Therefore, particular operative portion 68 may not move into recess 76, e.g., plate 136 may prevent particular operative portion 68 from entering into recess 76. Accordingly, pickup rollers 25 may not move away from bottom plate 84. In a situation in which particular operative portion 68 would move into recess 76 and pickup rollers 25 would be moved away from bottom plate 84, and the minimum size of recording sheets are loaded onto sheet feed 20, rotation of pickup rollers 25 may not be conveyed to the recording sheet when the trailing end of the last sheet of the minimum size passes over recess 76, and the last sheet may not be conveyed to feed roller 50, because the length of sheet feed path from recess 76 to feed roller 50 may be longer than the specific dimension, e.g., length, of a recording sheet of the minimum size in sheet feeding direction 91.

In an embodiment, recess 76 is covered to prevent particular operative portion 68 from entering recess 76, even when the last sheet of the minimum size passes over recess 76. Pickup rollers 25 therefore may not move away from bottom plate 84, and rotation of pickup rollers 25 may be applied to the last recording sheet of the minimum size, until the last sheet reaches feed roller 50. In other words, pickup rollers 25 may feed the last recording sheet of the minimum size until its leading end is held by feed roller 50. Thus, occurrences of a sheet feeding failure, e.g., that the last recording sheet of the minimum size jams in sheet feed path 22, may be reduced.

Figure 11A:
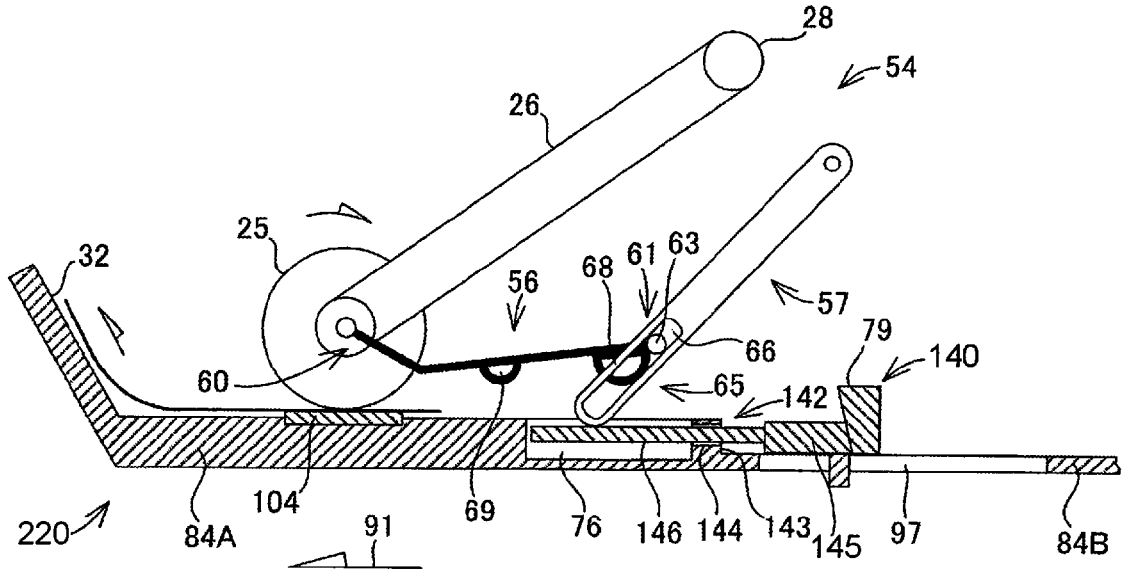
FIGS. 11A and 11B are cross-sectional views of a sheet feed tray, according to another embodiment.
Figure 11B:
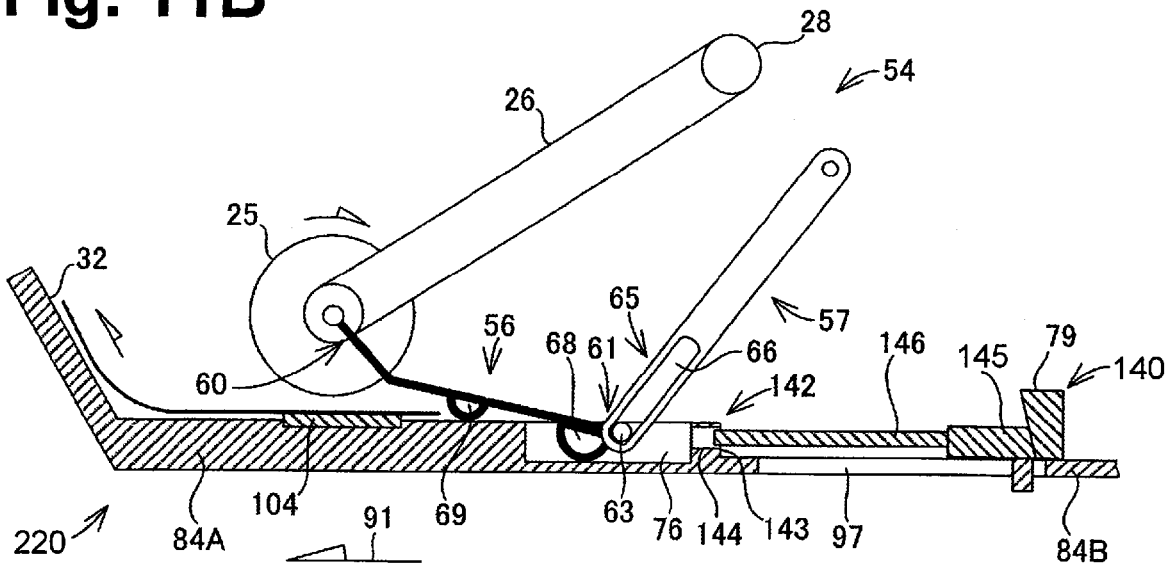

In this embodiment, only one side guide 81 comprises plate 136. However, in another embodiment, each side guide 80, 81 may comprise a plate 136. Referring to FIGS. 11A and 11B, in another embodiment, a sheet feed tray 220 may be similar to sheet feed tray 20. The differences between sheet feed tray 220 and sheet feed tray 20 are discussed with respect to sheet feed tray 220, and the portions of sheet feed tray 220 which are the same as sheet feed tray 20 are omitted. The bottom plate 84 of sheet feed tray 220 may comprise an upper portion 84A and a lower portion 84B. Further, side guide 81 may not comprise plate 136, and sheet feed tray 220 may comprise a rear guide 140 instead of rear guide 120. In the embodiment disclosed above, side guide 81 may function as a positioning member. In this embodiment, however, rear guide 140 may function as a positioning member.

Upper portion 84A may be positioned on the downstream side of bottom plate 84 in sheet feeding direction 91. The recording sheets may be loaded onto sheet feed tray 220 such that a portion of the recording sheets on their downstream side in sheet feeding direction 91 are positioned on upper portion 84A. Lower portion 84B may be positioned on the upstream side of bottom plate 84 in sheet feeding direction 91. A vertical step 142 may be formed between upper portion 84A and lower portion 84B to raise upper portion 84A. Rear guide 140 may be positioned on lower portion 84B.

Rear guide 140 may be positioned substantially in a middle portion of lower portion 84B in width direction 94. Lower portion 84B may have a groove 97 formed thereon. Rear guide 140 may be selectively, slidably movable within lower portion 84B, along groove 97 in sheet feeding direction 91 and in an opposite direction from sheet feeding direction 91. Step 142 may restrict the movement of rear guide 140 in sheet feeding direction 91. Rear guide 140 may position recording sheets in sheet feed tray 220. Similarly to rear guide 120, rear guide 140 may contact the upstream ends of recording sheets, which may be loaded onto sheet feed tray 220, in sheet feeding direction 91. Thus, rear guide 140 may restrict the movement of recording sheets in sheet feed tray 220 in the upstream side in sheet feeding direction 91.

When rear guide 140 is slidably moved along groove 97 in sheet feeding direction 91 with the recording sheets loaded onto sheet feed tray 220, the rear guide 140 may contact trailing ends of the recording sheets. Rear guide 140, may align and position the upstream ends of the recording sheets in sheet feeding direction 91 at a location corresponding to the size of the recording sheets. The downstream ends of the recording sheets in sheet feeding direction 91 may be placed at a predetermined position adjacent to inclined plate 32, regardless of the sizes of the recording sheets in sheet feed tray 220, Specifically, rear guide 140 may align the downstream ends of recording sheets loaded onto sheet feed tray 220 in sheet feeding direction 91 with a reference position.

Rear guide 140 may comprise a lever 79, a supporting portion 145, and a restriction member, e.g., a plate 146. Supporting portion 145 and plate 146 each may comprise a flat plate member positioned parallel to lower portion 84B. The upstream ends of the recording sheets loaded onto sheet feed tray 220 may be placed on the upper surface of supporting portion 145. The inner surface of lever 79 may be substantially perpendicular to lower portion 84B. With the recording sheet placed on supporting portion 145, the upstream ends of the recording sheets in the sheet feeding direction 91 may contact the inner surface of lever 79.

Upper portion 84A may have recess 76 formed therein. Step 142 may comprise a vertical surface 143 having a through hole 144 leading to recess 76 formed therethrough. Plate 146 may be inserted into through hole 144 when rear guide 140 slidably moves in sheet feeding direction 91 in sheet feed tray 220. As shown in FIG. 11A, in an embodiment, when recording sheets of the minimum size, e.g., the standard photo size, are loaded onto sheet feed tray 220, and rear guide 140 is moved to the second position to position recording sheets of the minimum size, plate 146 may move into through hole 144. Thus, plate 146 may cover recess 76. As shown in FIG. 11B, when rear guide 140 is moved to the first position to position recording sheets with the sizes larger than the minimum size, plate 146 may be pulled from through hole 144, as shown in FIG. 11B.

When rear guide 140 is moved to the second position to position recording sheets of minimum size, e.g., standard photo size, plate 146 may cover recess 76. As shown in FIG. 11A, when the trailing end of the last recording sheet of the minimum size passes over recess 76, pickup rollers 25 may not move away from bottom plate 84. Therefore, rotation of pickup rollers 25 may be applied to the last recording sheet of the minimum size until the last sheet reaches feed roller 50. Pickup rollers 25 may feed the last recording sheet of the minimum size until its leading end reaches feed roller 50.

Thus, occurrences of a sheet feeding failure, e.g., that the last recording sheet of the minimum size jams in sheet feed path 22, may be reduced.

In the above embodiments, moving mechanism 54 is an example of a moving device. Nevertheless, the moving device is not limited to moving mechanism 54. A mechanism in which supporting operative member 57 is removed from moving mechanism 54 may be used as the moving device. Further, a different moving mechanism, e.g., a moving mechanism described in one or more embodiments of U.S. Patent Application Publication No. 20070081199, the entirety of which is herein incorporated by reference, may be employed.

Referring to FIGS. 12 to 20, a sheet feed tray 320 may be similar to sheet feed tray 20. The differences between sheet feed tray 320 and sheet feed tray 20 are discussed with respect to sheet feed tray 320, and the portions of sheet feed tray 320 which are the same as sheet feed tray 20 are omitted. Sheet feed tray 320 may comprise a positioning member, e.g., a side guide 181, instead of side guide 81; a restriction member, e.g., a restriction piece 156, may be positioned at bottom wall 117 of side guide 181, instead of a plate 136 positioned at bottom wall 117 of side guide 81; the restriction member e.g., restriction piece 156 may be positioned at one of side guides 180, 181 on a side wall 123 side, i.e., side guide 181; and sheet feed tray 320 may comprise a groove 151 and a supporting device, e.g., a protrusion 153 positioned on bottom plate 84.

Referring to FIGS. 12-15, side guide 181 may comprise restriction piece 156 positioned on bottom wall 117 of side guide 181. Restriction piece 156 may extend from bottom wall 117 in the movement direction of side guide 181, e.g., toward the middle portion of sheet feed tray 320 in width direction 94. Restriction piece 156 may be positioned at substantially the same position as recess 76 with respect to sheet feeding direction 91. Restriction piece 156 may have a similar function as plate 136, e.g., restriction piece 156 may cover recess 76 when side guide 181 is moved to the second bottom position to prevent particular operative portion 68 from moving into recess 76.

Figure 18:
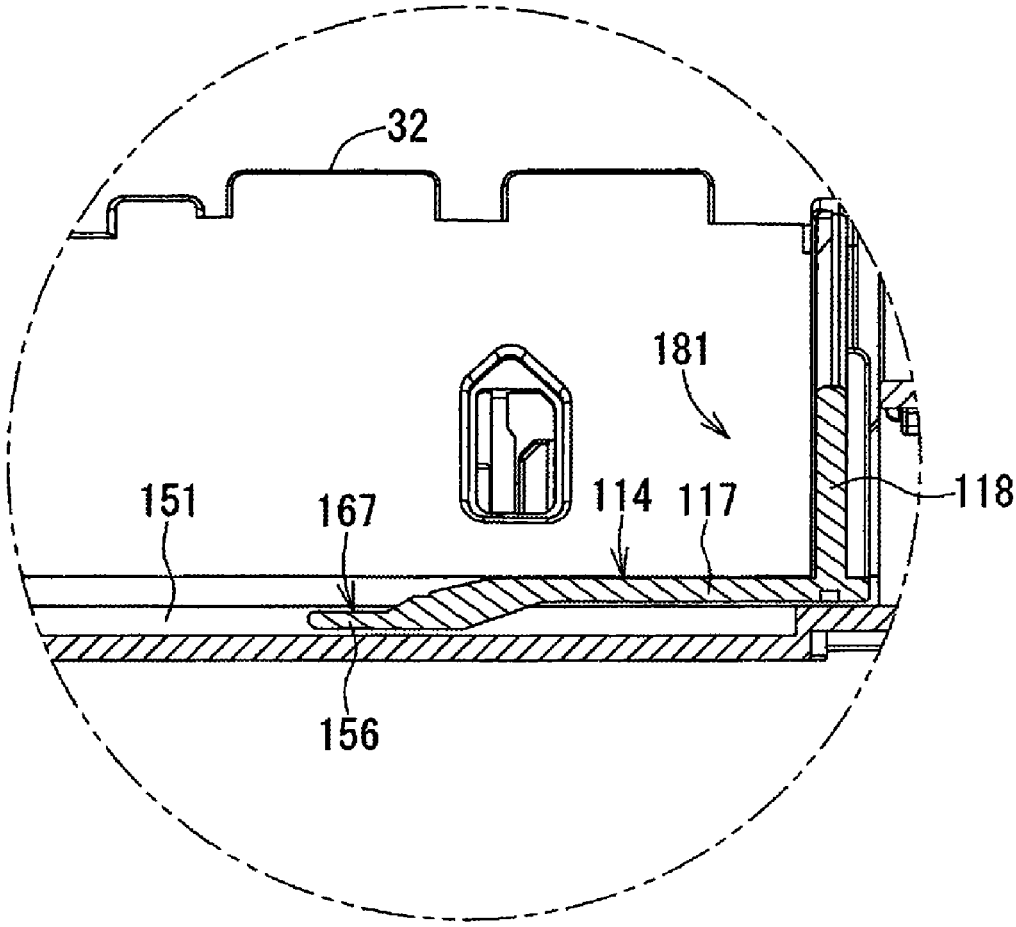
FIG. 18 is an enlarged view of section XVIII of FIG. 16.

Restriction piece 156 may have a substantially triangular shape in a plan view, that may taper down from bottom wall 117 toward a substantially middle portion of sheet feed tray 320 in width direction 94. Restriction piece 156 may extend in width direction 94 from the bottom surface of bottom wall 117 parallel to bottom wall 117. The position of restriction member 156 with respect to the height direction, e.g., vertical direction, may be different from the position of the bottom wall 117 in the height direction. Referring to FIG. 18, an upper surface 167 of restriction piece 156 may be positioned lower than an upper surface 114 of bottom wall 117. When recording sheets are loaded onto sheet feed tray 320, the recording sheets may be inserted into sheet feed tray 320 while sliding on the upper surfaces of bottom walls 117, 127. At this time, the middle portion of the stack of the recording sheets in the width direction 94 may flex downward. If upper surface 167 of restriction piece 156 is positioned at the same height as upper surface 114 of bottom wall 117 or higher than upper surface 114, the leading ends of the recording sheets may jam, e.g., become caught or entangled, in restriction piece 156 while the recording sheets are being loaded onto sheet feed tray 320, which may prevent proper setting of the recording sheets in sheet feed tray 320. In this embodiment, upper surface 167 of restriction piece 156 may be positioned lower than upper surface 114 of bottom wall 117, so that the recording sheets may not get caught in restriction piece 156.

Figure 12:
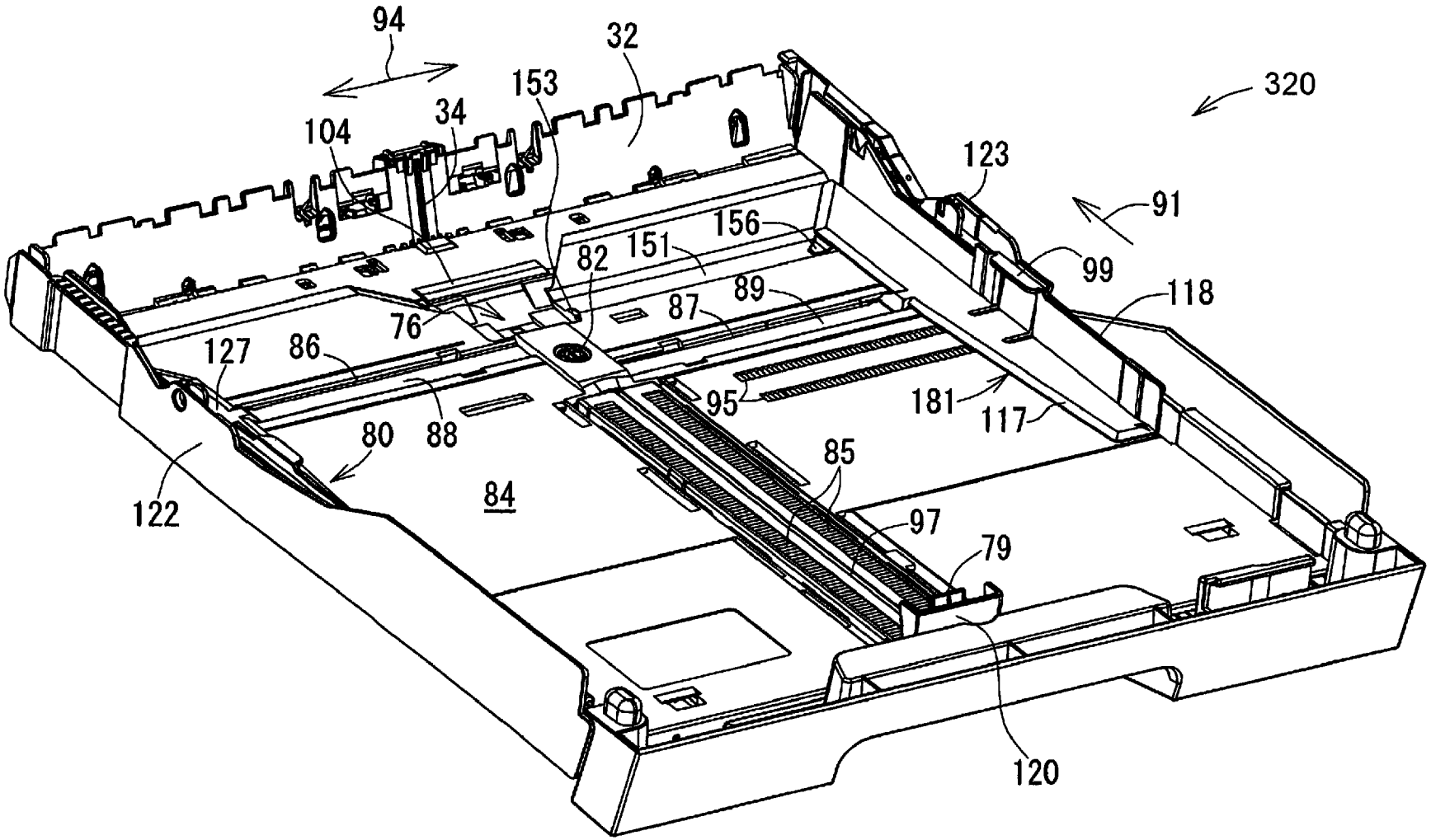
FIG. 12 is a perspective view of a sheet feed tray according to yet another embodiment in which side guides are in the first bottom position.
Figure 13:
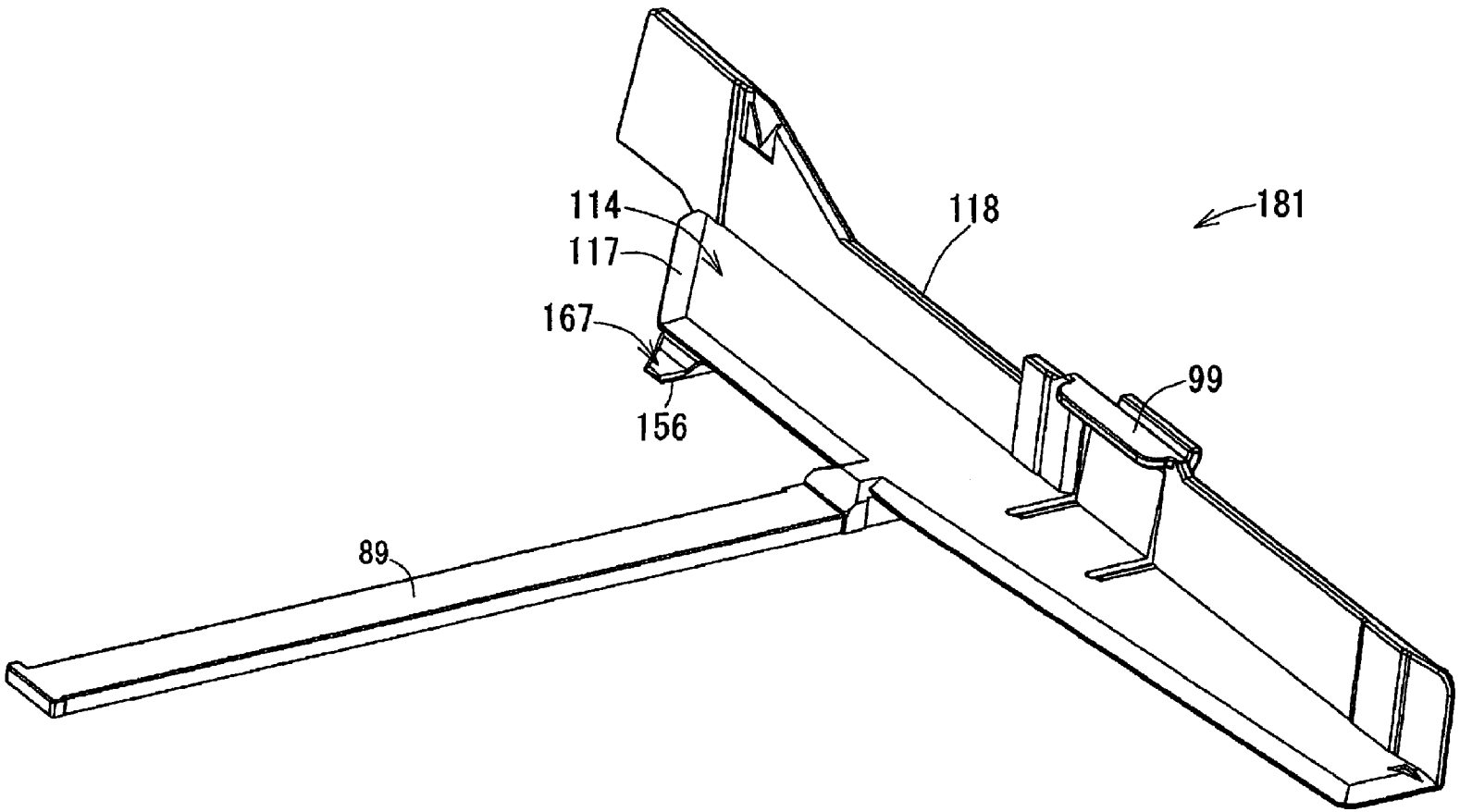
FIG. 13 is a perspective view of the side guide according to yet another embodiment, viewed from the top.
Figure 14:
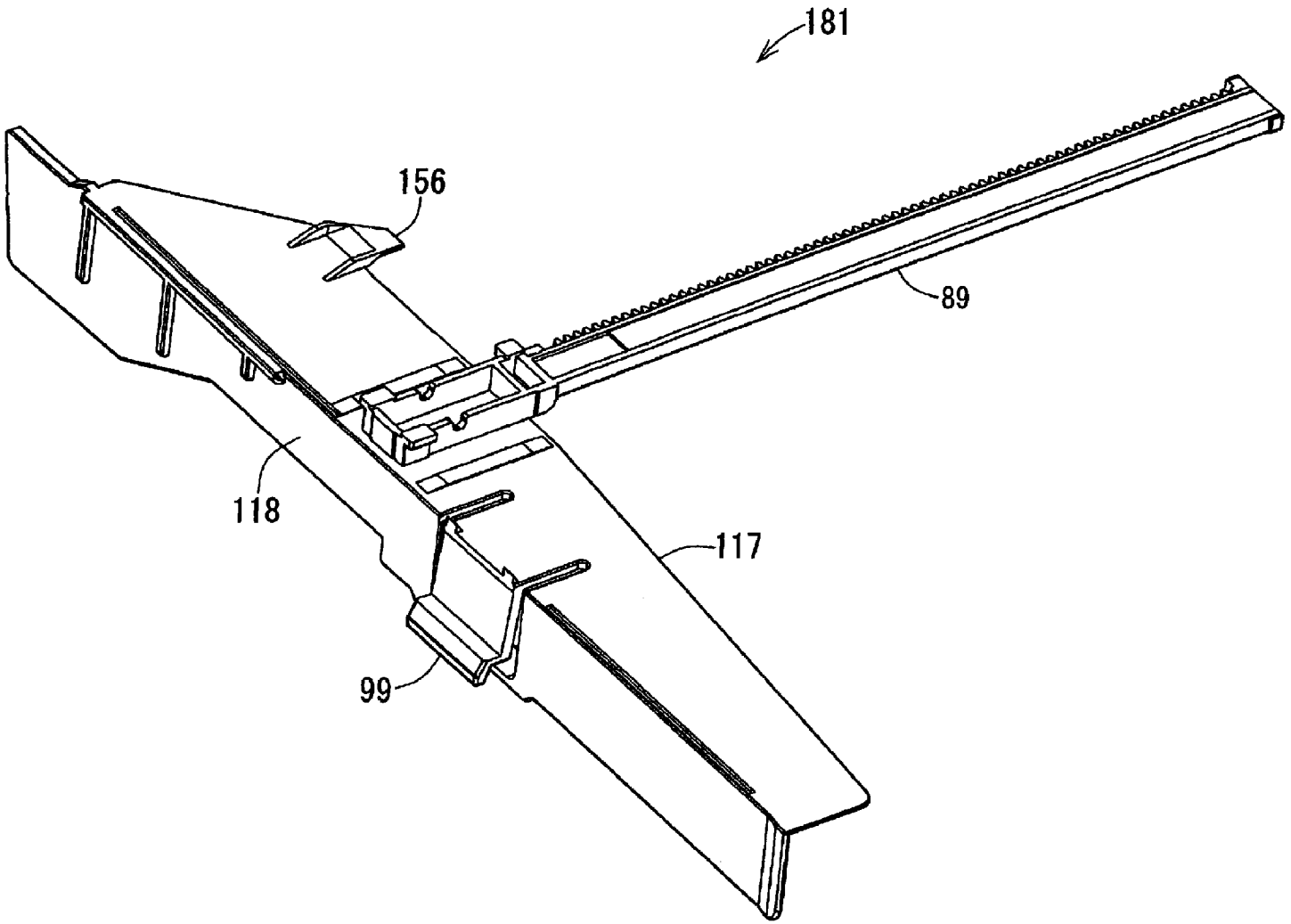
FIG. 14 is a perspective view of the side guide according to yet another embodiment, viewed from the rear.

Referring to FIGS. 12-16, sheet feed tray 320 may comprise groove 151 positioned on bottom plate 84 of sheet feed tray 320. Groove 151 may function as a space for accommodating restriction piece 156. Groove 151 may be positioned on a side of recess 76 close to side wall 123, i.e., a right side when positioned as shown in FIG. 12. Groove 151 may extend in the movement direction of side guide 181, e.g., width direction 94. Groove 151 may be formed at substantially the same position as recess 76 in sheet feeding direction 91. The width and depth of groove 151 may be set to prevent restriction piece 156 from contacting with groove 151 when side guide 181 is assembled to sheet feed tray 320. The width of groove 151 in sheet feeding direction 91 may be set wider than the width of restriction piece 156. The depth of groove 151 may be set slightly deeper than the protruding amount of restriction piece 156 from the bottom surface of bottom wall 117. When side guide 181 is moved in width direction 94, restriction piece 156 may move in the same direction as side guide 181 along groove 151.

Figure 19:
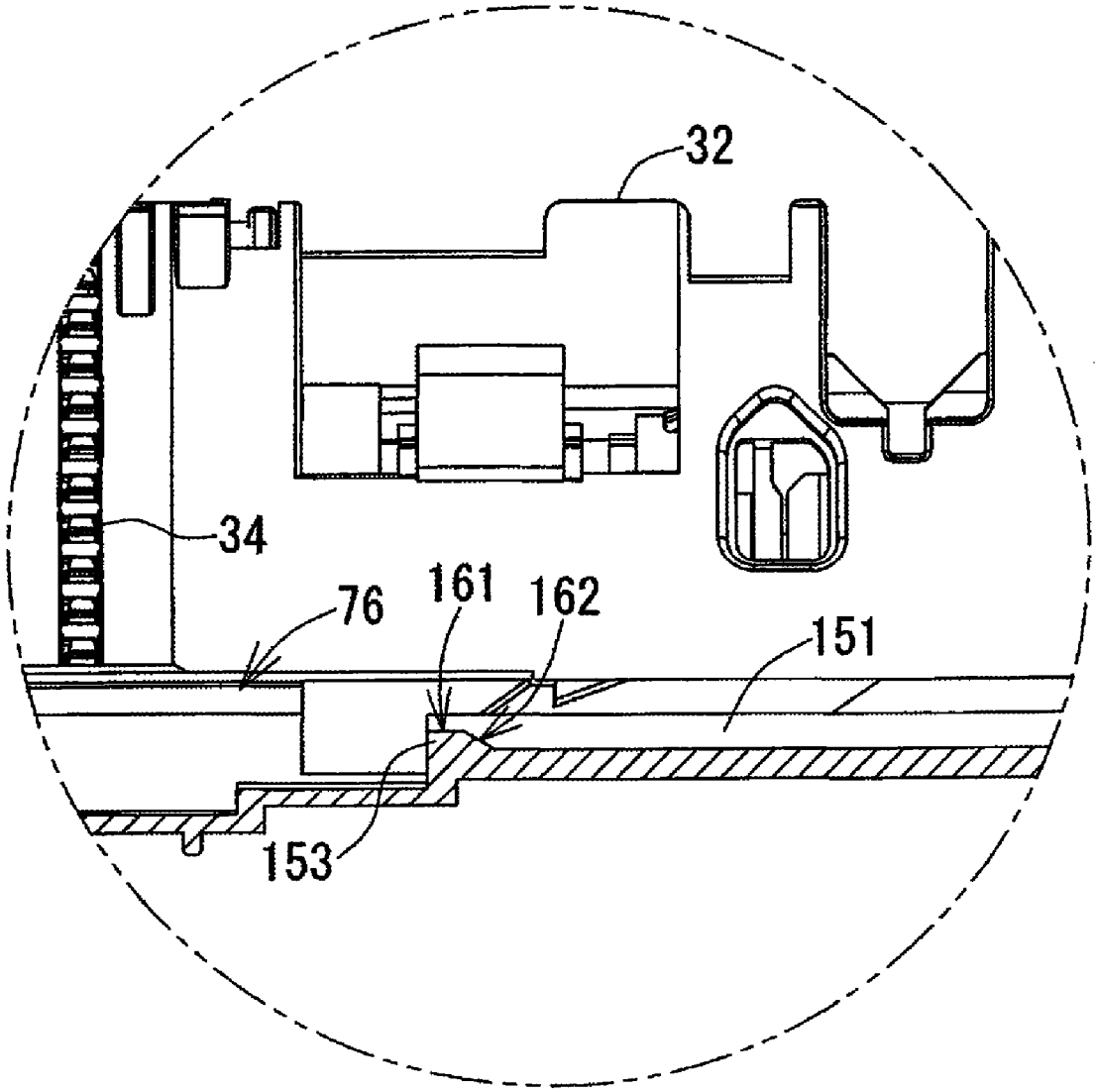
FIG. 19 is an enlarged view of section XIX of FIG. 16.

Protrusion 153 may be positioned on bottom plate 84 near recess 76. Referring to FIG. 19, protrusion 153 may be positioned on the bottom surface of groove 151 adjacent to recess 76. Referring back to FIG. 12, protrusion 153 may be disposed at substantially the same position as restriction piece 156 in sheet feeding direction 91. Referring again to FIG. 19, protrusion 153 may comprise a horizontal surface 161 and an incline surface 162. Horizontal surface 161 may be positioned higher than the bottom surface of groove 151, and lower than the upper surface of bottom plate 84. Incline surface 162 may be positioned at an angle to connect horizontal surface 161 and the bottom surface of groove 151. Incline surface 162 may be positioned higher as incline surface 162 approaches recess 76 in width direction 94.

With protrusion 153, an influence of rattle, e.g., vibrations, of side guide 181, or poor transmission of rotating force of pickup rollers 25 to the recording sheet, may be reduced. More specifically, side guide 181 may be configured to move in width direction 94 relative to sheet feed tray 320, such that side guide 181 may rattle. Restriction piece 156 may be positioned on bottom wall 117 of side guide 181, so that restriction piece 156 may be influenced by the rattle of side guide 181. Due to the influence of rattle of side guide 181, the position of restriction piece 156 in the height, e.g., the vertical, direction may vary especially when side guide 181 is moved to the second bottom position.

Further, restriction piece 156 may deform when particular operative portion 68 is supported by restriction piece 156, due to load applied by moving mechanism 54 to restriction piece 156. Due to the influence of rattle, e.g., vibrations, of side guide 181 and deformation of restriction piece 156, the position of restriction piece 156 in the height, e.g., the vertical, direction may vary when side guide 181 is moved to the second bottom position.

Protrusion 153, may reduce an occurrence of particular operative portion 68 moving toward recess 76 by approximately the distance between upper surface 167 and upper surface 114 when the trailing end of the last remaining recording sheet of the standard photo size passes recess 76, because upper surface 167 of restriction piece 156 may be positioned lower than upper surface 114 of bottom wall 117, as described above. This may cause prevent or reduce the occurrence of a decrease in transmission quality of rotating force of pickup rollers 25 to the last remaining sheet, as pickup rollers 25 move away from bottom plate 84 of sheet feed tray 320, which may reduce failures of feeding the standard photo-size sheet. Protrusion 153 may reduce the variances in positions of restriction piece 156 in the height, e.g., vertical, direction and sheet feeding failures.

Figure 15:
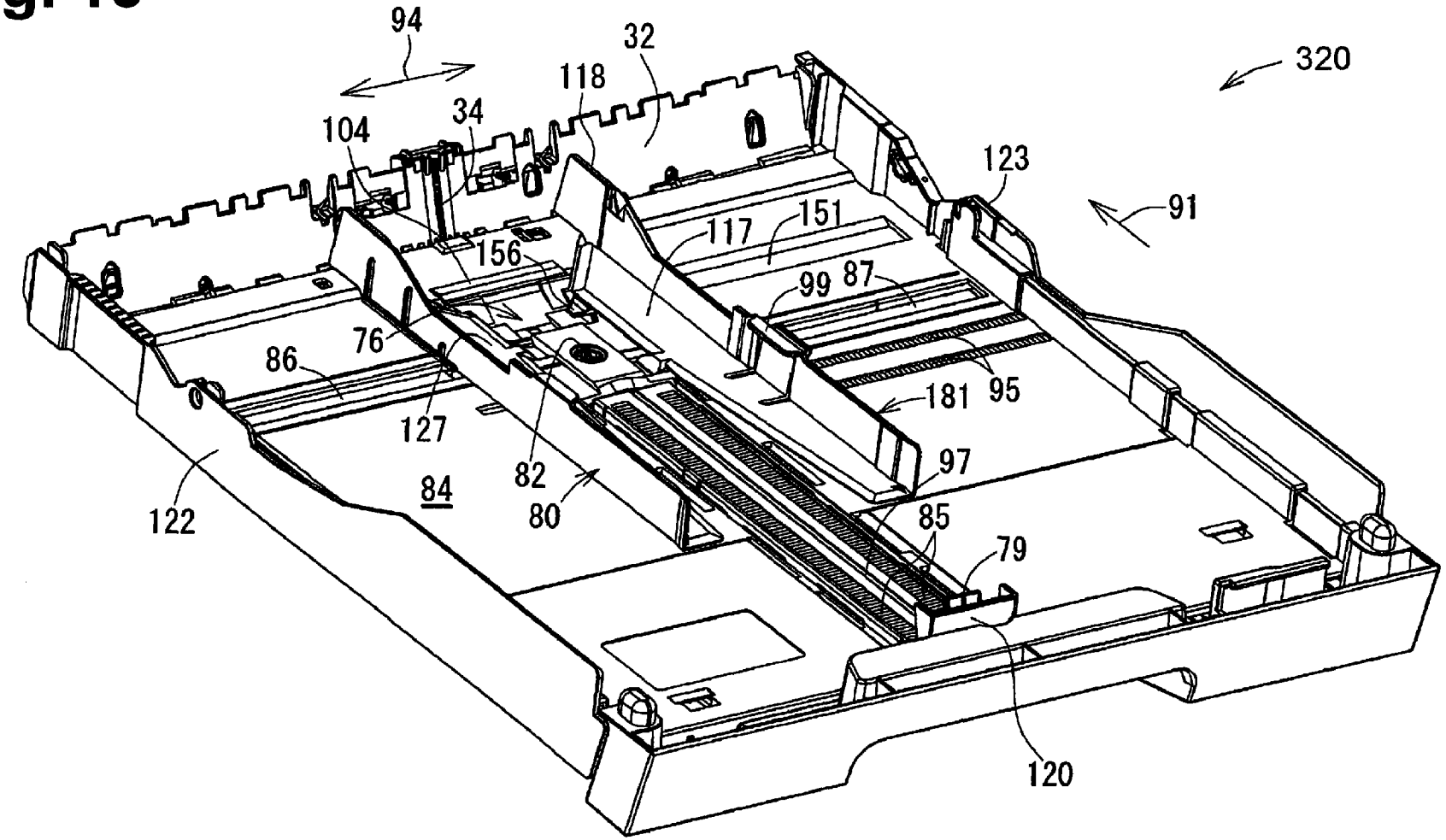
FIG. 15 is a perspective view of the sheet feed tray according to yet another embodiment, in which the side guides are in the second position.
Figure 16:
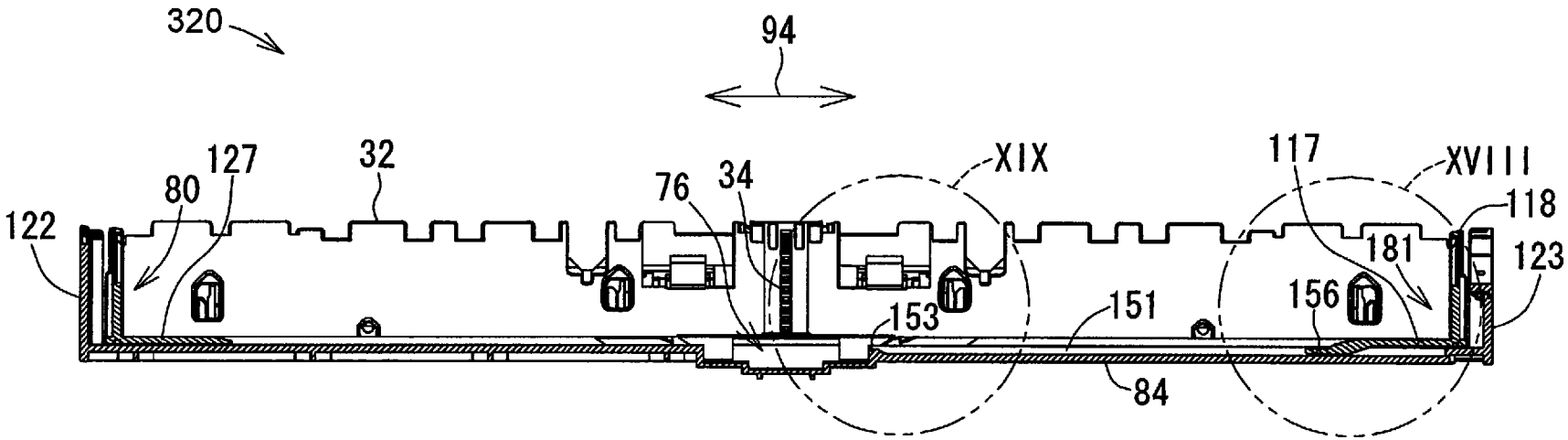
FIG. 16 is a vertical cross-sectional view of the sheet feed tray according to yet another embodiment, in which the side guides are in the first bottom position.
Figure 17:
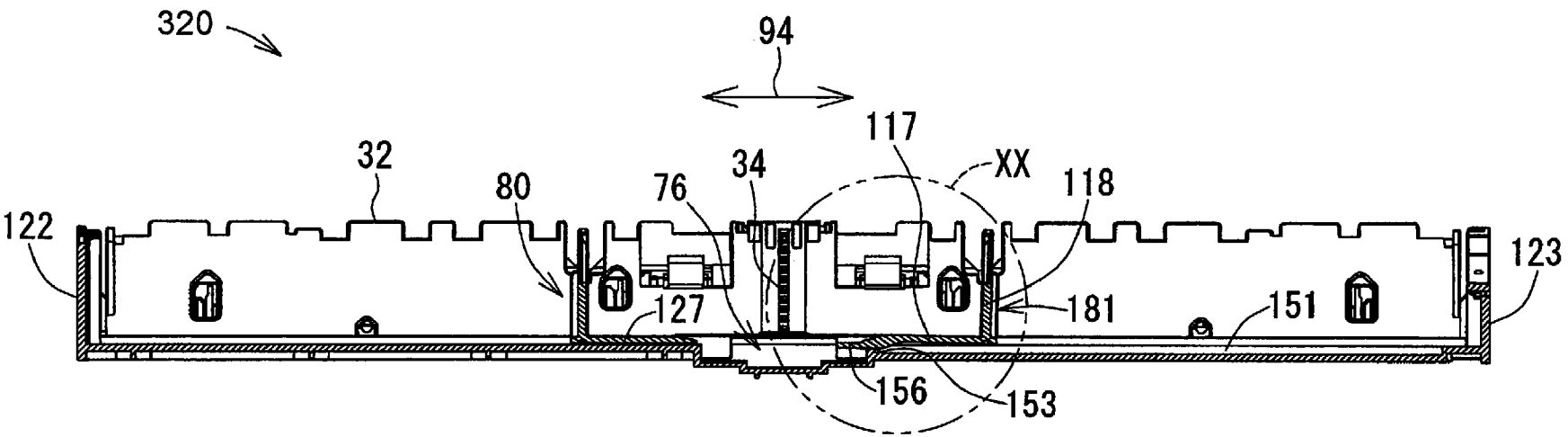
FIG. 17 is a vertical cross-sectional view of the sheet feed tray according to yet another embodiment, in which the side guides are in the second position.
Figure 20:
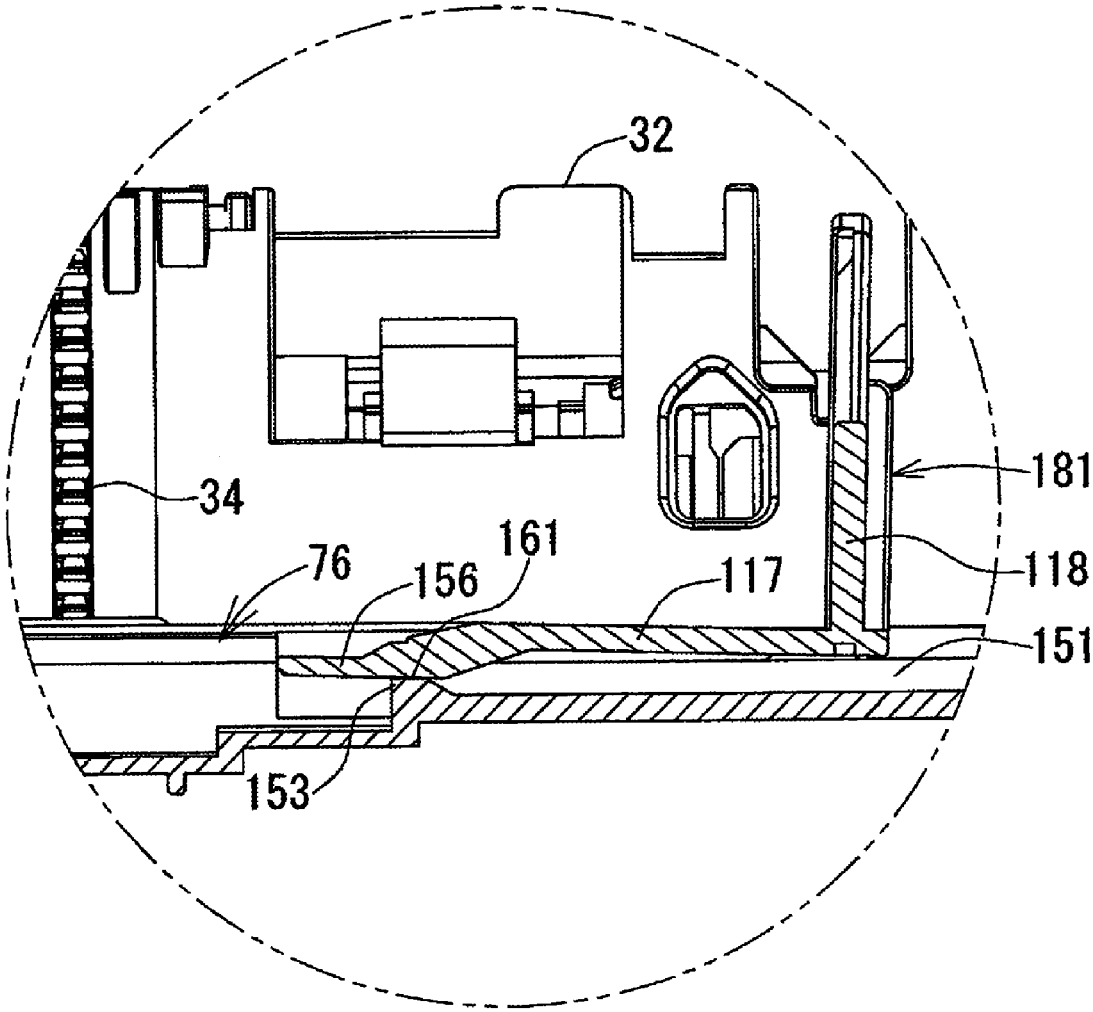
FIG. 20 is an enlarged view of section XX of FIG. 17.

Referring to FIGS. 12-16, when side guide 181 is moved to the first position, restriction piece 156 may be positioned away from recess 76. In this state, restriction piece 156 may not cover recess 76, and particular operative portion 68 may be allowed to move therein. When side guide 181 is moved to the second bottom position, restriction piece 156 may cover a portion of recess 76. As shown in FIGS. 15 and 20, a portion of recess 76 on a side of side wall 123 may be covered by restriction piece 156. As shown in FIG. 20, protrusion 153 may raise restriction piece 156 when side guide 181 is moved to the second bottom position and restriction piece 156 is positioned above recess 76. Specifically, restriction piece 156 may be raised along incline surface 162, while side guide 181 may be moved to the second bottom position, and restriction piece 156 may be supported from below by horizontal surface 161 of protrusion 153.

The height difference between horizontal surface 161 and the bottom surface of groove 151 preferably may be set to be substantially equal to or slightly greater than the height difference between upper surface 167 of restriction piece 156 and upper surface 114 of bottom wall 117. In this embodiment, when the trailing end of the last remaining sheet of the standard photo size passes recess 76, with side guide 181 moved to the second bottom position, particular operative portion 68 may not move toward recess 76.

As described above, when side guide 181 is moved to the second bottom position, restriction piece 156 may be supported from below while being raised by protrusion 153. Therefore, restriction piece 156 may reliably prevent the movement of particular operative portion 68 into recess 76. Consequently, pickup rollers 25 may not move away from bottom plate 84 and the rotating force of pickup rollers 25 reliably may be transmitted to the sheet until the trailing end of the last remaining sheet of the standard photo size passes pickup rollers 25. Therefore, sheet feeding failures that may occur when the standard photo-size sheets are fed may be reduced.

In an embodiment, restriction piece 156 may be raised by protrusion 153. However, a structure may be employed that may allow bottom wall 117 to be raised by protrusion 153, and in turn restriction piece 156 may be raised together with bottom wall 117. Further, bottom wall 117 may be raised by protrusion 153 while restriction piece 156 may not be raised when side guide 181 is moved to the second bottom position, by positioning restriction piece 156 at a position different from protrusion 153 in sheet feeding direction 91.

While the invention has been described in connection with various exemplary structures and illustrative embodiments, it will be understood by those skilled in the art that other variations and modifications of the structures and embodiments described above may be made without departing from the scope of the invention. Other structures and embodiments will be apparent to those skilled in the art from a consideration of the specification or practice of the invention disclosed herein. It is intended that the specification and the described examples are illustrative with the true scope of the invention being defined by the following claims.

What is claimed is:

1. A sheet conveying device, comprising:

a tray comprising a bottom surface, wherein the tray is configured to hold at least one sheet therein, and has a recess formed in the bottom surface;

a particular rotating member configured to move between a first position in which the particular rotating member contacts the at least one sheet held in the tray and a second position in which the particular rotating member is separated from the tray, and wherein the particular rotating member is configured to rotate to selectively convey one of the at least one sheet held in the tray in a particular direction when the particular rotating member is in the first position;

a particular operative portion configured to selectively move into and out of the recess, wherein a movement of the particular operative portion into the recess corresponds to a movement of the particular rotating member into the second position;

a moving device configured to selectively move the particular operative portion into and out of the recess;

a positioning member configured to move along the bottom surface of the tray between a first bottom position and a second bottom position; and a preventing member configured to prevent the particular operative portion from moving into the recess when the positioning member is in the second bottom position, and to allow the particular operative portion to move into the recess when the positioning member is in the first bottom position, wherein when the positioning member is in the second bottom position, the tray is configured to hold a sheet of a first predetermined size, and when the positioning member is in the first bottom position, the tray is configured to hold a sheet of a second predetermined size, which is greater than the first predetermined size.

2. The sheet conveying device of claim 1, wherein the particular operative portion is configured to move into the recess when the at least one sheet is not held in the tray, and to move out of the recess to contact the at least one sheet when the at least one sheet is held in the tray.

3. The sheet conveying device of claim 1, further comprising a further rotating member positioned downstream of the particular rotating member in the conveying direction, wherein the further rotating member is configured to further convey the one of the at least one sheet conveyed from the particular rotating member, wherein the sheet of the first predetermined size has a width and a length longer than the width, and the length of the sheet of the first predetermined size is greater than a length of a portion of the conveying path extending from the particular rotating member to the further rotating member, and the length of the sheet of the first predetermined size is less than a length of a portion of the conveying path extending from the recess to the further rotating member.

4. The sheet conveying device of claim 3, wherein the first predetermined size corresponds to a minimum size of a sheet which the particular rotating member and the further rotating member are configured to convey.

5. The sheet conveying device of claim 1, further comprising a supporting member configured to movably support the particular rotating member, wherein the moving device comprises:

an operative member extending upstream of the particular rotating member in the conveying direction, wherein an end of the operative member is pivotally connected to the supporting member; and a further operative portion positioned at a lower surface of a downstream side of the operative member in the conveying direction, wherein the particular operative portion is positioned upstream of the further operative portion in the conveying direction, at the lower surface of the operative member, and the further operative portion is configured to contact the bottom surface of the tray to move the supporting member away from the bottom surface when the particular operative portion moves into the recess.

6. A sheet conveying device, comprising:

a tray comprising a bottom surface, wherein the tray is configured to hold at least one sheet therein, and has a recess formed in the bottom surface;

a particular rotating member configured to move between a first position in which the particular rotating member contacts the at least one sheet held in the tray and a second position in which the particular rotating member is separated from the tray, and wherein the particular rotating member is configured to rotate to selectively convey one of the at least one sheet held in the tray in a particular direction when the particular rotating member is in the first position;

a particular operative portion configured to selectively move into and out of the recess, wherein a movement of the particular operative portion into the recess corresponds to a movement of the particular rotating member into the second position;

a moving device configured to selectively move the particular operative portion into and out of the recess; and a positioning member configured to move along the bottom surface of the tray between a first bottom position and a second bottom position, wherein the positioning member comprises a preventing member configured to cover at least a portion of the recess to prevent the particular operative portion from moving into the recess when the positioning member is in the second bottom position, and the tray is configured to hold a sheet of a first predetermined size, and when the positioning member is in the first bottom position the tray is configured to hold a sheet of a second predetermined size, which is greater than the first predetermined size.

7. The sheet conveying device of claim 6, wherein the positioning member comprises a first plate extending along the bottom surface of the tray and a second plate extending upward from the first plate, and the first plate is configured to support an edge of the at least one sheet held in the tray from below.

8. The sheet conveying device of claim 7, wherein, the preventing member extends from the first plate in a same direction as a direction in which the positioning member moves.

9. The sheet conveying device of claim 8, further comprising a protrusion configured to support the preventing member when the positioning member is in the second bottom position, wherein an upper surface of the preventing member is positioned below than an upper surface of the first plate, and the protrusion is configured to raise the preventing member when the positioning member moves from the first bottom position to the second bottom position.

10. The sheet conveying device of claim 9, wherein the protrusion is positioned adjacent to the recess on the bottom surface of the tray.

11. The sheet conveying device of claim 7, wherein the positioning member is configured to move along the bottom surface of the tray in a direction perpendicular to the conveying direction, and the second plate is configured to position the edge of the at least one sheet held in the tray in a direction intersecting the conveying direction.

12. The sheet conveying device of claim 7, wherein the positioning member is configured to move along the bottom surface of the tray in the conveying direction, and the second plate is configured to position the edge of the at least one sheet held in the tray in the conveying direction.

13. The sheet conveying device of claim 7, further comprising a protrusion configured to support the preventing member when the positioning member is in the second bottom position, wherein an upper surface of the preventing member is positioned below than an upper surface of the first plate, and the protrusion is configured to raise the preventing member when the positioning member moves from the first bottom position to the second bottom position.

14. The sheet conveying device of claim 13, wherein the protrusion is positioned adjacent to the recess on the bottom surface of the tray.

15. The sheet conveying device of claim 6, further comprising a protrusion configured to support the preventing member when the positioning member is in the second bottom position.

16. A sheet conveying device, comprising:

a tray comprising a bottom surface, wherein the tray is configured to hold at least one sheet therein, and has a recess formed in the bottom surface;

a particular rotating member configured to move between a first position in which the particular rotating member contacts the at least one sheet held in the tray and a second position in which the particular rotating member is separated from the tray, and wherein the particular rotating member is configured to rotate to selectively convey one of the at least one sheet held in the tray in a particular direction when the particular rotating member is in the first position;

a particular operative portion configured to selectively move into and out of the recess, wherein a movement of the particular operative portion into the recess corresponds to a movement of the particular rotating member into the second position;

a moving device configured to selectively move the particular operative portion into and out of the recess;

two positioning members, configured to move in opposite directions along the bottom surface of the tray; and two preventing members, each configured to prevent the particular operative portion from moving into the recess when the two positioning members are at a predetermined position, and to allow the particular operative portion to move into the recess when the two positioning members are at a further position different from the predetermined position.

17. An image recording apparatus comprising:

a sheet conveying device, comprising:

a tray comprising a bottom surface, wherein the tray is configured to hold at least one sheet therein, and has a recess formed in the bottom surface;

a particular rotating member configured to move between a first position in which the particular rotating member contacts the at least one sheet held in the tray and a second position in which the particular rotating member is separated from the tray, and wherein the particular rotating member is configured to rotate to selectively convey one of the at least one sheet held in the tray in a particular direction when the particular rotating member is in the first position;

a particular operative portion configured to selectively move into and out of the recess, wherein a movement of the particular operative portion into the recess corresponds to a movement of the particular rotating member into the second position;

a moving device configured to selectively move the particular operative portion into and out of the recess;

a positioning member configured to move along the bottom surface of the tray between a first bottom position and a second bottom position; and a preventing member configured to prevent the particular operative portion from moving into the recess when the positioning member is in the second bottom position, and to allow the particular operative portion to move into the recess when the positioning member is in the first bottom position; and a recording device configured to record an image on the sheet conveyed by the sheet conveying device, wherein when the positioning member is in the second bottom position, the tray is configured to hold a sheet of a first predetermined size, and when the positioning member is in the first bottom position, the tray is configured to hold a sheet of a second predetermined size, which is greater than the first predetermined size.

* * * * *